US008109604B2

(12) United States Patent
Iijima

(10) Patent No.: US 8,109,604 B2
(45) Date of Patent: Feb. 7, 2012

(54) INKJET RECORDING HEAD

(75) Inventor: Yasushi Iijima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 927 days.

(21) Appl. No.: 11/832,833

(22) Filed: Aug. 2, 2007

(65) Prior Publication Data

US 2008/0030545 A1 Feb. 7, 2008

(30) Foreign Application Priority Data

Aug. 7, 2006 (JP) ..... 2006-214180

(51) Int. Cl.
*B41J 2/15* (2006.01)

(52) U.S. Cl. ..... 347/40; 347/47

(58) Field of Classification Search ..... 347/40, 347/43, 47

See application file for complete search history.

(56) References Cited

U.S. PATENT DOCUMENTS

| | | | | |
|---|---|---|---|---|
| 6,789,877 | B2 * | 9/2004 | Murakami et al. | 347/40 |
| 6,964,467 | B2 | 11/2005 | Kaneko et al. | |
| 7,077,500 | B2 | 7/2006 | Yabe | |
| 7,118,193 | B2 | 10/2006 | Kaneko et al. | |
| 7,303,260 | B2 | 12/2007 | Osada et al. | |
| 7,384,129 | B2 | 6/2008 | Nagata et al. | |
| 7,591,537 | B2 * | 9/2009 | Tsuchii et al. | 347/43 |
| 7,625,065 | B2 * | 12/2009 | Kanda et al. | 347/43 |
| 7,641,309 | B2 * | 1/2010 | Teshigawara et al. | 347/43 |
| 2002/0105557 | A1 * | 8/2002 | Teshigawara et al. | 347/40 |
| 2002/0113845 | A1 | 8/2002 | Yazawa et al. | |
| 2004/0021731 | A1 | 2/2004 | Yabe et al. | |
| 2004/0090480 | A1 | 5/2004 | Teshikawara et al. | |
| 2006/0050107 | A1 * | 3/2006 | Yamanaka et al. | 347/40 |
| 2006/0050110 | A1 | 3/2006 | Osada et al. | |
| 2008/0143786 | A1 * | 6/2008 | Oikawa et al. | 347/47 |

FOREIGN PATENT DOCUMENTS

| | | | |
|---|---|---|---|
| EP | 1228876 | A2 | 8/2002 |
| EP | 1356940 | A2 | 10/2003 |
| EP | 1415818 | A1 | 5/2004 |
| JP | 2001-171119 | A | 6/2001 |
| JP | 3183797 | | 7/2001 |
| JP | 2004001489 | A | 1/2004 |
| JP | 2006-76011 | A | 3/2006 |
| JP | 2006-192891 | A | 7/2006 |
| KR | 10-2003-0084661 | | 11/2003 |
| KR | 1020060049523 | | 5/2006 |

OTHER PUBLICATIONS

Japanese Office Action issued in corresponding Application No. 2006-214180 dated Jul. 1, 2011; 5 pages.

* cited by examiner

*Primary Examiner* — Charlie Peng
(74) *Attorney, Agent, or Firm* — Fitzpatrick, Cella, Harper & Scinto

(57) ABSTRACT

Two arrays of ejection openings which eject relatively large amounts of ink are provided for each of different color inks and are disposed at symmetrical positions in the order of colors in a direction corresponding to a record scan. In addition, a single array of ejection openings which eject relatively small amounts of ink is disposed for at least one color ink. Since the symmetrical disposition in the color order of the ejection opening arrays which eject large amounts of ink prevents color unevenness from appearing even when the bidirectional recording is performed. Since the single array is formed of the ejection openings which eject small amount of ink, and which is used for highly precise recording, it is possible to avoid image deterioration due to the shift of dot formed positions, even when the recording head is mounted in an inclined manner attributable to the variation in manufacturing.

3 Claims, 17 Drawing Sheets

INKJET RECORDING HEAD

BACKGROUND OF THE INVENTION

1. Field of the Invention

The present invention relates to an inkjet recording head for ejecting ink to perform recording.

2. Description of the Related Art

Along with spread of a copying machine, a communication apparatus and an information processing apparatus such as a word processor and a personal computer, an inkjet recording apparatus for recording using an inkjet system has been developed as one of output devices for recording (printing) images for those apparatuses. An inkjet recording apparatus has advantages that an inkjet recording head (hereinafter, also simply referred to as a recording head) serving as recording means can be easily made compact, and that highly precise images can be recorded at a high speed. In addition, recording can be performed on plain paper without requiring special processing, and thus running costs are low. Moreover, noise during recording is low, since the inkjet recording apparatus employs a non-impact method. Furthermore, color-image recording is easily performed by using inks of several kinds of color tones (colors and/or concentration).

Recently, along with spread of the inkjet recording apparatus having these advantages, higher precision and higher speed of recording operations have been desired. To meet these demands, a recording head composed of a large number of densely arranged ejection openings is used in the inkjet recording apparatus. Moreover, in an inkjet recording apparatus capable of color recording, a recording head has a plurality of ejection opening arrays disposed corresponding to a plurality of color inks.

As the type of the inkjet recording apparatuses, there are a so-called line printer type and serial printer type. The latter is mainly used as a printer for personal or office use because of its relatively small size. In the serial printer type, main scanning and sub scanning are alternately performed to form an image. More precisely, in the main scanning, ink is ejected while the recording head is moved relative to a recording medium in a direction different from a direction of the ejection opening array. Meanwhile, in the sub scanning, the recording medium is moved relatively in a direction perpendicular to the main scanning direction. In the serial printer type inkjet recording apparatus, recording operations at a higher speed is achieved by performing bidirectional recording in which recording operations are performed in main scanning both in the forward and backward directions.

However, when a bidirectional color recording is performed using the recording head in which the ejection opening arrays for ejecting multiple colors of inks, for example, a cyan (C), a magenta (M) and a yellow (Y) are disposed in the main scanning direction, the order of ejecting these inks differs between the forward and backward directions of the main scanning. Accordingly, the order of applying these inks to the recording medium differs between the forward and backward directions of the main scanning. Consequently, a secondary color is not developed uniformly, and this causes unevenness in the secondary color having stripes with different color tones.

In order to deal with this problem, a technique is known in which ejection opening arrays for colors are disposed symmetrically in a recording head. For example, Japanese Patent Laid-open No. 2001-171119 discloses a structure in which an ejection opening array for C, an ejection opening array for M, an ejection opening array for Y, and another ejection opening array for Y, another ejection opening array for M and another ejection opening array for C are disposed in this order in the main scanning direction, and thereby the order of the color disposition is symmetrical. By use of the recording head with such disposition, the bidirectional color recording can be performed in the same order of applying the inks in the forward and backward directions of the main scanning. Thus, the secondary color can be developed uniformly.

On the other hand, ink droplets which are ejected from a recording head and adhere to a recording medium spread on the recording medium and form dots. Image is recorded as an assembly of the dots. The area per dot depends on the size of droplet, i.e., the amount of ejected ink. To achieve high image quality recording equivalent to a silver salt photography with high precision by use of the inkjet method, there is a trend that an ink droplet ejected from a recording head is made as fine as possible.

As a method for achieving such high precision recording, a technique is known in which an image is formed by combining dots formed of droplets with different sizes (different amounts of ejected ink). According to this method, it is possible to arrange dots with different diameters in an image, and thereby an image can be recorded by forming dots with relatively small diameters on a part of the image in which granular impression is likely to be noticeable, and by forming dots with relatively large diameters on a "solid" part of the image. Accordingly, the granular impression of the image is reduced, while the wide area of the "solid" part can be filled efficiently with a small number of ink ejections. Thus, high image quality recording can be performed at a high speed.

It is expected to achieve a high image quality recording at a higher speed by employing a symmetrical disposition of ejection opening arrays suitable for the aforementioned bidirectional recording in a recording head having a structure capable of ejecting different amounts of ink.

FIG. 16A shows a schematic plan view of the inkjet recording apparatus showing such a structural example. The recording head is formed on a Si substrate 10. On the substrate 10, five ink supplying ports denoted by the reference numerals 131 to 135 are disposed in the main scanning direction in parallel manner. Here, the ink supplying ports 131 and 135 correspond to a cyan ink. The ink supplying ports 132 and 134 located inner sides of ports 131 and 135 correspond to magenta ink. The ink supplying port 133 located in the center of the five ink supplying ports corresponds to yellow ink. To each of the ink supplying ports, ejection opening arrays and ink paths are provided. In the ejection opening arrays, a number of ejection openings are arranged in the sub scanning direction with a predetermined density (600 dpi (dots per inch)). The ink paths communicate with each ejection opening. In other words, the inkjet recording head is constructed symmetrically in the recording scanning direction in terms of the color order. The recording medium is to be provided with inks in the order of a cyan, magenta and yellow either in the forward scanning direction or in the backward scanning direction. In a part of the ink paths, energy generating element such as electrothermal transducer element (heater) is formed, and a driving signal is supplied via electrode portions 12 formed on the edge of the substrate.

On both sides of the ink supplying ports 131, 132, 134 and 135, ejection opening arrays CL1, ML1, ML2 and CL2 which eject relatively large amounts of ink, and ejection opening arrays CS1, MS1, MS2 and CS2, which eject relatively small amounts of ink, are disposed, respectively. On the other hand, on both sides of the ink supplying port 133, ejection opening arrays (YL1 and YL2) which eject relatively large amounts of ink are disposed. Here, as to the yellow ink, only the ejection opening arrays which eject relatively large amounts of ink are disposed. This is because the yellow ink has relatively low visibility as compared to the cyan ink and the magenta ink, the granular impression thereof is not substantially influenced even by the larger dots. Consequently, the effect of reducing the droplet size is small.

In the relation between the ejection opening arrays which eject relatively large amounts of ink in each color, the ejection openings are offset by ½ of the arrangement pitch in the sub scanning direction, and have a relation to complement one another, achieving a recording resolution of 1200 dpi. Moreover, as to the ejection opening arrays which eject relatively small amounts of the cyan ink and the magenta ink, the same relation is established.

In such a recording head, as to a cyan and a magenta, image with a recording density of 1200 dpi can be formed by use of large and small dots. Meanwhile, as to yellow, image with a recording density of 1200 dpi can be formed by use of large dots. Moreover, when recording is performed, especially emphasizing the speed to a plain paper sheet, the bidirectional recording can be performed on the same image area by use of only the ejection opening arrays which eject relatively large amounts of ink. At this time, since the ejection opening arrays for the same color ink are symmetrically disposed, the same order of applying inks in the forward and backward directions of the main scanning, and thereby it is possible to prevent the unevenness in the secondary color from occurring. Furthermore, for example, by performing the multiple main scanning (multi-pass recording) in accordance with the pixel arrangement complementary to the same image area, while effectively utilizing the ejection opening arrays which eject relatively small amounts of ink, it is possible to form a highly precise image with less granular impression.

However, when the present inventor has examined the above recording head, it is found that the symmetry disposition irrespective of the amount of the ejected ink causes the following problems. Hereinafter, descriptions will be given of the problems.

The recording head is positioned to a guide shaft of the recording apparatus via a number of members, i.e. carriage and other plural of components, and the main scanning is performed. Thus, as shown in FIG. 16A, if each ejection opening array is disposed accurately vertical to the guide shaft, the ejection opening arrays apart from each other (in this case, for the cyan ink, the ejection opening arrays CL1 and CL2, and the ejection opening arrays CS1 and CS2, for example) can complement each other. In reality, however, the recording head or the carriage may have a variation in the production, thereby the recording head is inclined to some extent, and the ejection opening arrays may not be completely perpendicular to the guide shaft.

FIG. 16B is an explanatory view of the state described above, showing the recording head which is inclined to the extending direction of the guide shaft, i.e. the main scanning direction by an angle θ. Due to such an inclination, the ejection openings in the ejection opening arrays CS1 and CS2, which should have a distance of approximately 21 μm (1/1200 inch) in the sub scanning direction, are further shifted by approximately 11 μm (1/2400 inch).

FIGS. 17A and 17B are schematic views showing dot formations corresponding to the ejection opening arrays for the cyan ink shown in FIGS. 16A and 16B, respectively. In FIGS. 17A and 17B, each of the drawings on the left shows the arrangements of dots c11 and c12 having relatively large diameters, which are formed by the ejection opening arrays CL1 and CL2 which eject relatively large amounts of ink, respectively. On the other hand, each of the drawings on the right shows the arrangements of dots cs1 and cs2 having relatively small diameters, which are formed by the ejection opening arrays CS1 and CS2 which eject relatively small amounts of ink, respectively.

In FIG. 16A, each ejection opening array is mounted completely perpendicular to the guide shaft. Thus, the ejection opening arrays CL1 and CL2 as well as CS1 and CS2, which are apart from each other, complement each other. As a result, the dots which are not shifted are formed as shown in FIG. 17A.

However, In FIG. 16B, the ejection openings in the ejection opening arrays located at a distance are shifted by more than the regular pitch. As a result, the shifted dots are formed as shown in FIG. 17B.

In this respect, if the ejection amount is sufficiently large, the formed dot diameter is also sufficiently large relative to the shifted distance as shown in FIG. 17B. Thus, the change of the area factor (the coverage of dots to a recording medium) is small in the sub scanning direction, and the influence thereof can be ignored. However, as to the ejection opening arrays which eject relatively small amounts of ink, the formed dots are small as shown in FIG. 17B. Thus, the ratio of change in the area factor to the sub scanning direction is relatively large.

The ratio of change in the area factor described herein is determined by the relation between the pitch in the ejection opening arrangement and the dot diameter. It becomes a problem when the dot diameter is small relative to the pitch in the ejection opening arrangement. Described above has been the case of arranging the ejection openings with a density of 1200 dpi. However, the same phenomenon would occur in a case of other arrangement density.

As described above, in the recording head shown in FIG. 16B, when the ejection opening arrays which eject relatively small amounts of ink are used for performing highly precise recording, large variations in an optical density may appear in the sub scanning direction, resulting in a problem that the stripes are more likely to be noticeable in the main scanning direction (horizontal direction). Moreover, the longer the shifting distance, the longer the distance between the ejection opening arrays in the main scanning direction. For this reason, the influence of the variations in the optical density is relatively increased in the order of yellow, magenta and cyan, resulting in a problem that the color balance may deteriorate as a whole.

Although the problems caused by the static shift has been described, dynamic factors such as vibration of the carriage or the guide shaft at the time of main scanning may cause the states shown in FIGS. 17A and 17B to occur repeatedly because of the difference between the positions of the aforementioned ejection opening arrays in the main scanning direction. In other words, when the ejection opening arrays which eject relatively small amounts of ink are used, the influence of variations in the optical density may increase due to the difference between the positions in the main scanning direction, resulting in a problem that strips may occur in the sub scanning direction (vertical direction).

SUMMARY OF THE INVENTION

Taking the above described problems into consideration, an object of the present invention is to provide a recording head which ejects different amounts of ink, capable of achieving a bidirectional recording at a high speed without color unevenness, and capable of highly precise recording which does not cause an image to be deteriorated due to static and dynamic shift of the recording head.

In the present invention, there is provided an inkjet recording head for performing recording by being scanned relative to a recording medium, wherein: at least two arrays of ejection openings which eject relatively large amounts of ink are provided for each of a plurality of color tone inks and are disposed at symmetrical positions in the order of colors in a direction corresponding to the scanning; and a single array of ejection openings which eject smaller amounts of ink than the two arrays of ejection openings is disposed for at least one of the plurality of color tone inks.

According to the present invention, the color unevenness can be prevented from occurring at the time of bidirectional recording, since the ejection opening arrays which eject relatively large amounts of ink are symmetrically disposed by each color tone. Moreover, since the ejection opening arrays which eject relatively small amounts of ink are formed of a single array, and which is used for high precision recording such as photo print, the deterioration in image such as variations in the optical density caused by shifted positions of dot formation can be suppressed, even if the inclination occurs in the state where the recording head is mounted due to a variation in manufacturing.

Further features of the present invention will become apparent from the following description of exemplary embodiments (with reference to the attached drawings).

DESCRIPTION OF THE EMBODIMENTS

Hereinafter, the present invention will be described in detail with reference to the drawings.

It should be noted that, herein, an "image" is referred to not only a case of forming information such as a character, a graphic, a drawing and a picture, but also a wide range of a design and a pattern formed on a recording medium, or colored on the entire surface thereof, irrespective of significant or insignificant. Moreover, "recording" refers to overall operations to form such an image. Furthermore, a "recording medium" refers to not only a paper sheet normally used in a recording apparatus, but also a wide range of articles which can receive ink such as fabric, plastic film, metallic plate, glass, ceramic, wood, leather, and the like, and also may refer to as "paper" hereinafter.

Basic Configuration of Recording Apparatus and Recording Head

Figure 1:
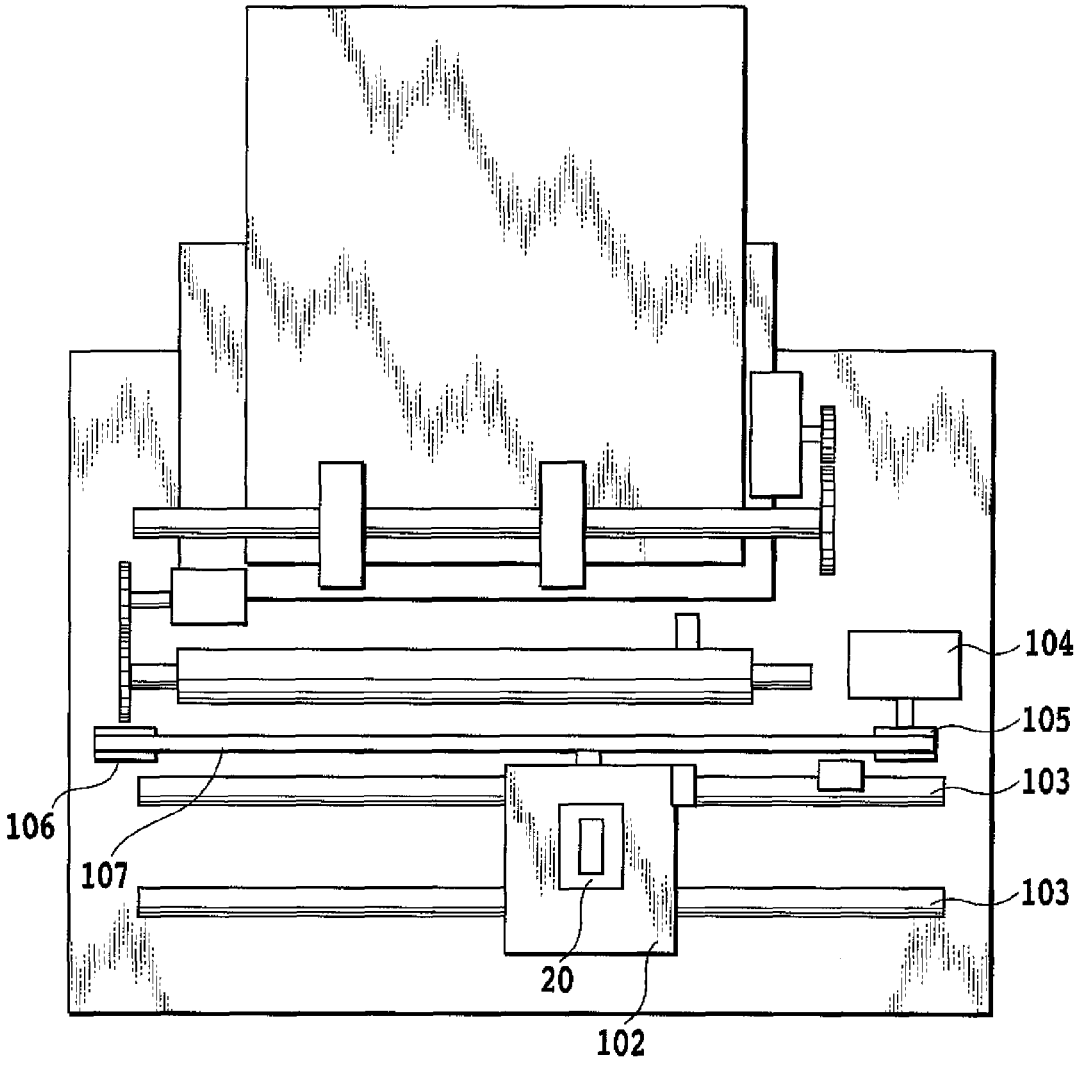
FIG. 1 is a schematic view showing an example of an inkjet recording apparatus capable of mounting an inkjet recording head according to the present invention.

FIG. 1 is a schematic view showing an example of an inkjet recording apparatus capable of mounting an inkjet recording head according to the present invention.

A recording head cartridge 20 which is replaceable shown in FIG. 1 is positioned to, and mounted on, a carriage 102. The carriage 102 is guided and supported by guide shafts 103 so that the carriage 102 is reciprocally movable along the guide shafts 103 which are mounted on the apparatus main body, and which extends in the main scanning direction. The carriage 102 is driven by a main scanning motor 104 via driving mechanisms such as a motor pulley 105, a driven pulley 106 and a timing belt 107, and at the same time the positions and movement of the carriage 102 are controlled.

Figure 2B:
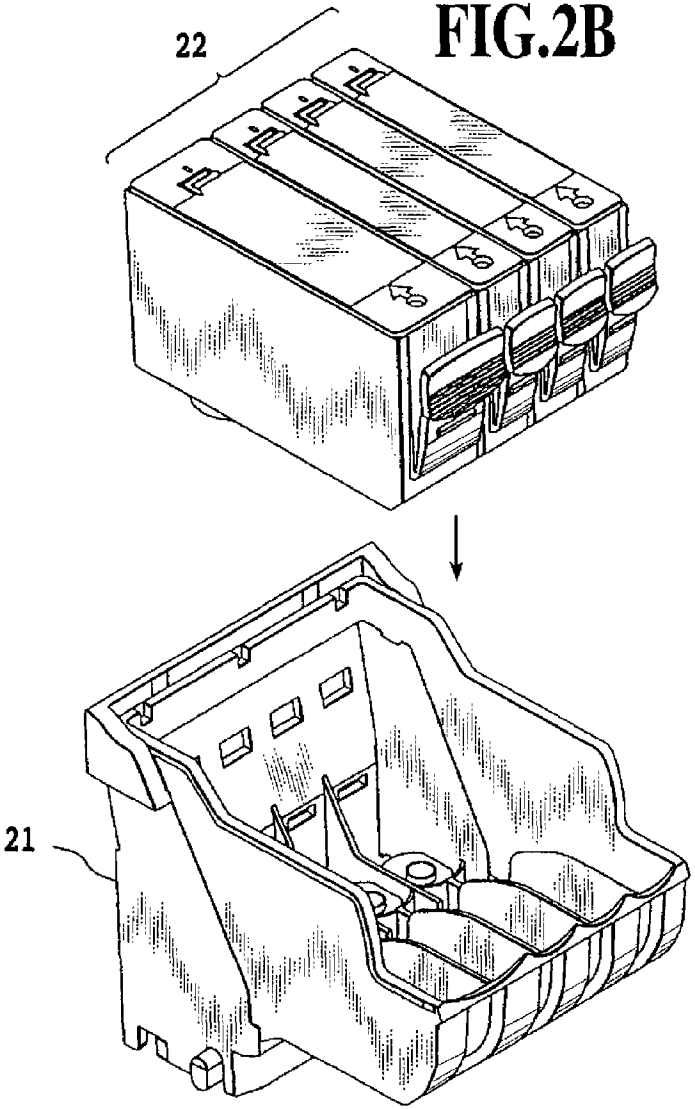
FIGS. 2A and 2B are perspective views each showing a recording head cartridge used in the apparatus of FIG. 1.
Figure 2A:
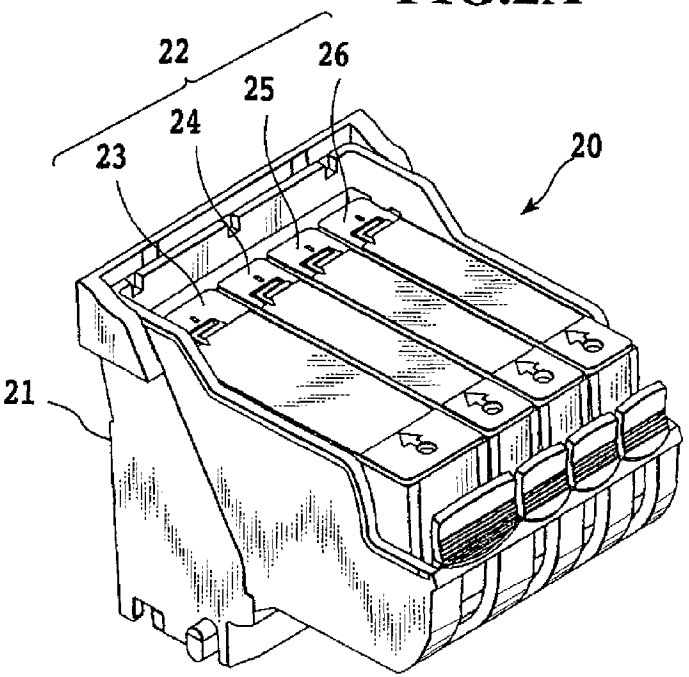

FIGS. 2A and 2B are perspective views each showing the recording head cartridge 20. The recording head cartridge 20 includes a recording head 21 and ink tanks 23, 24, 25 and 26 (hereinafter, unless otherwise specified, referred to as a reference numeral 22) which are detachably provided to the recording head 21. These ink tanks 23, 24, 25 and 26 can be corresponded to, for example, the respective color inks of black, cyan, magenta and yellow. The recording head 21 ejects, from ejection openings, inks supplied from the ink tanks 22 in accordance with recording information. Here, the ink tanks are detachable independently from each other and replaceable individually. For this reason, the running cost of recording by the inkjet recording apparatus can be reduced.

The recording head cartridge 20 is fixed and supported by positioning means and electrically connecting points of the carriage 102 placed on the inkjet recording apparatus main body, and is detachable from the carriage 102. The recording head 21 uses a recording head main body which performs recording by using a resistor (heater) that generates a heat energy for generating film boiling for ink in response to electric signals.

Figure 3:
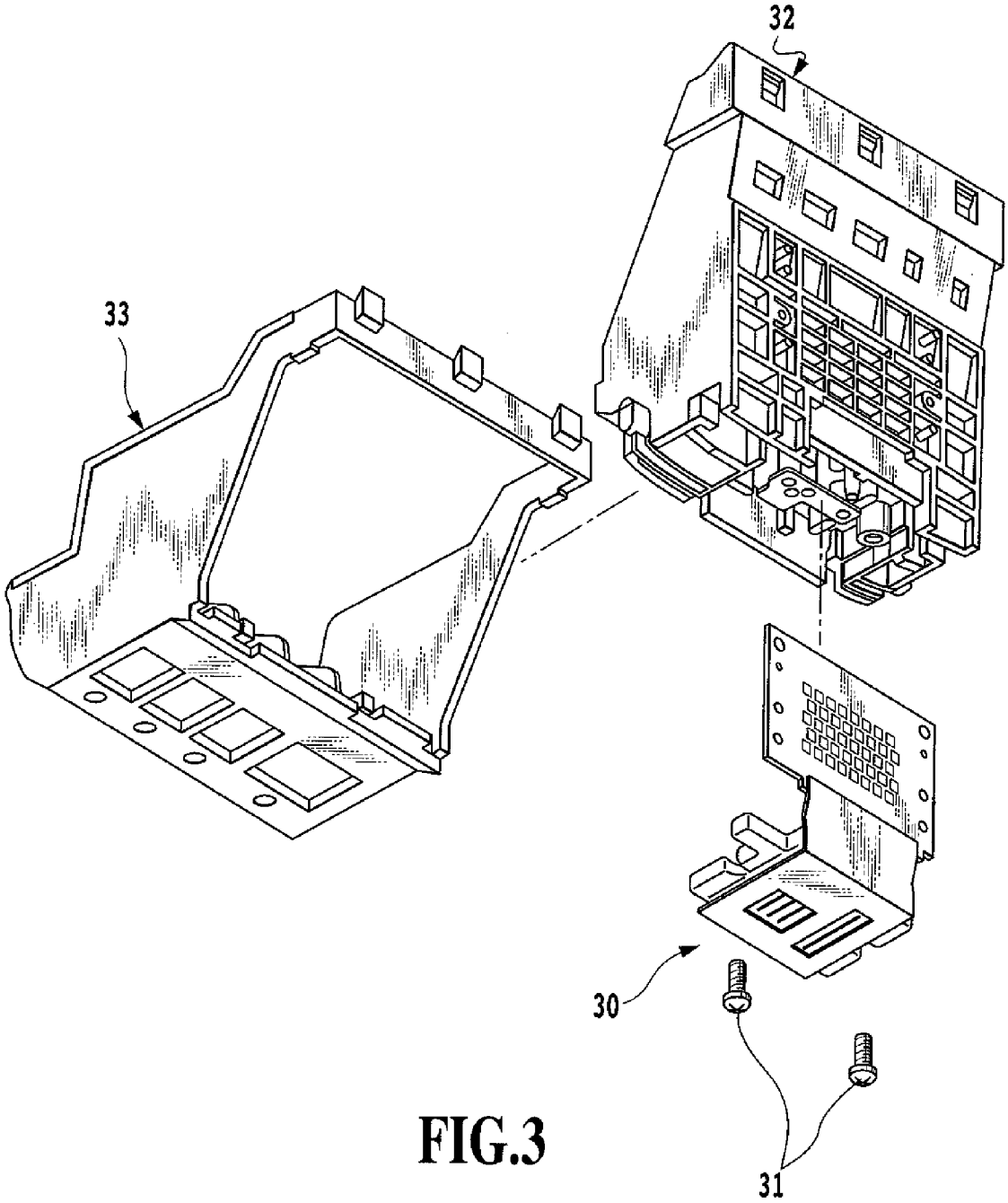
FIG. 3 is an exploded perspective view showing a schematic configuration of the recording head provided to the recording head cartridge of FIGS. 2A and 2B.
Figure 4:
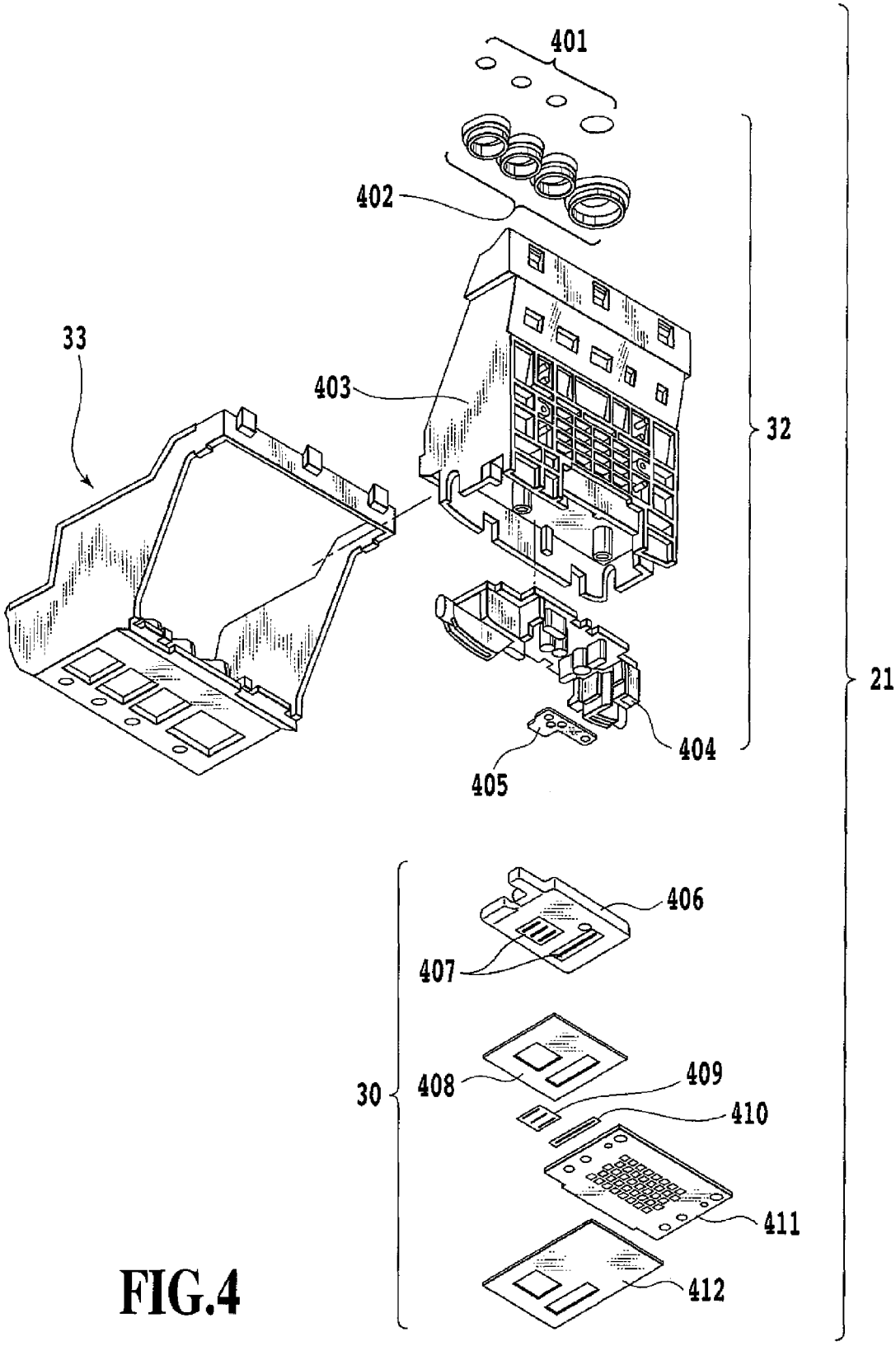
FIG. 4 is an exploded perspective view showing a further detailed configuration of the recording head of FIG. 3.

FIG. 3 is an exploded perspective view showing a schematic configuration of the recording head 21. FIG. 4 is an exploded perspective view showing a detailed configuration of the recording head. As shown in these drawings, the recording head 21 generally includes a recording element unit 30, an ink supplying unit 32 and a tank holder 33. In order to communicate an ink communication hole of the recording element unit 30 with an ink communication hole of the ink supplying unit 33 without causing any leakage of inks, a joint seal member 405 which adheres to the vicinities of both communication holes is inserted therebetween. Then, both of the recording element unit 30 and the ink supplying unit 32 are fixed by screwing screws 31 into screw-fastening-boss portions of the ink supplying unit 32 through two screw fixing positions in the recording element unit 30.

The recording element unit 30 has the following configuration elements: first and second recording element boards 410 and 409; a first plate 406 serving as a support member; electric wiring tape 412 serving as a flexible wiring member; electric contact board 411; and a second plate 408 which serves as a second support member and which accommodates the recording element boards.

Here, the first recording element board 410 is for black ink, and second recording element board 409 is for cyan, magenta and yellow inks. These recording element boards 409 and 410 adhere to and are fixed to the first plate 406 which includes ink communication holes 407. The second plate 408 which includes openings for the recording element boards adheres to and is fixed to the first plate 406. Furthermore, the electric wiring tape 412 is adhered and fixed to the second plate 408 so as to maintain the positional relation relative to the recording element boards 410 and 409. The electric wiring tape 412 sends an electric signal for ejecting inks to the recording element boards 410 and 409. Specifically, the electric wiring tape 412 has electric wirings corresponding to each of the recording element boards, and is connected to the electric contact board 411 provided with an external signal input terminal for receiving an electrical signal from the inkjet apparatus main body.

The ink supplying unit 32 is configured of an ink supplying member 403, a path forming member 404, a joint seal rubber (seal member) 405, filters 401 and seal rubbers 402. When the ink tanks 22 are mounted in the tank holder 33, an ink conducting portion of the ink tanks 22 abuts the filters 401, and the abutting portion is surrounded by the seal rubbers 402. Thus, the state of ink communication with the ink supplying member 403 is secured without leakage. The ink supplied from the ink tanks 22 is introduced to the path forming member 404, and supplied to each recording element board via ink communication ports 407 formed in the first plate 406.

Figure 5:
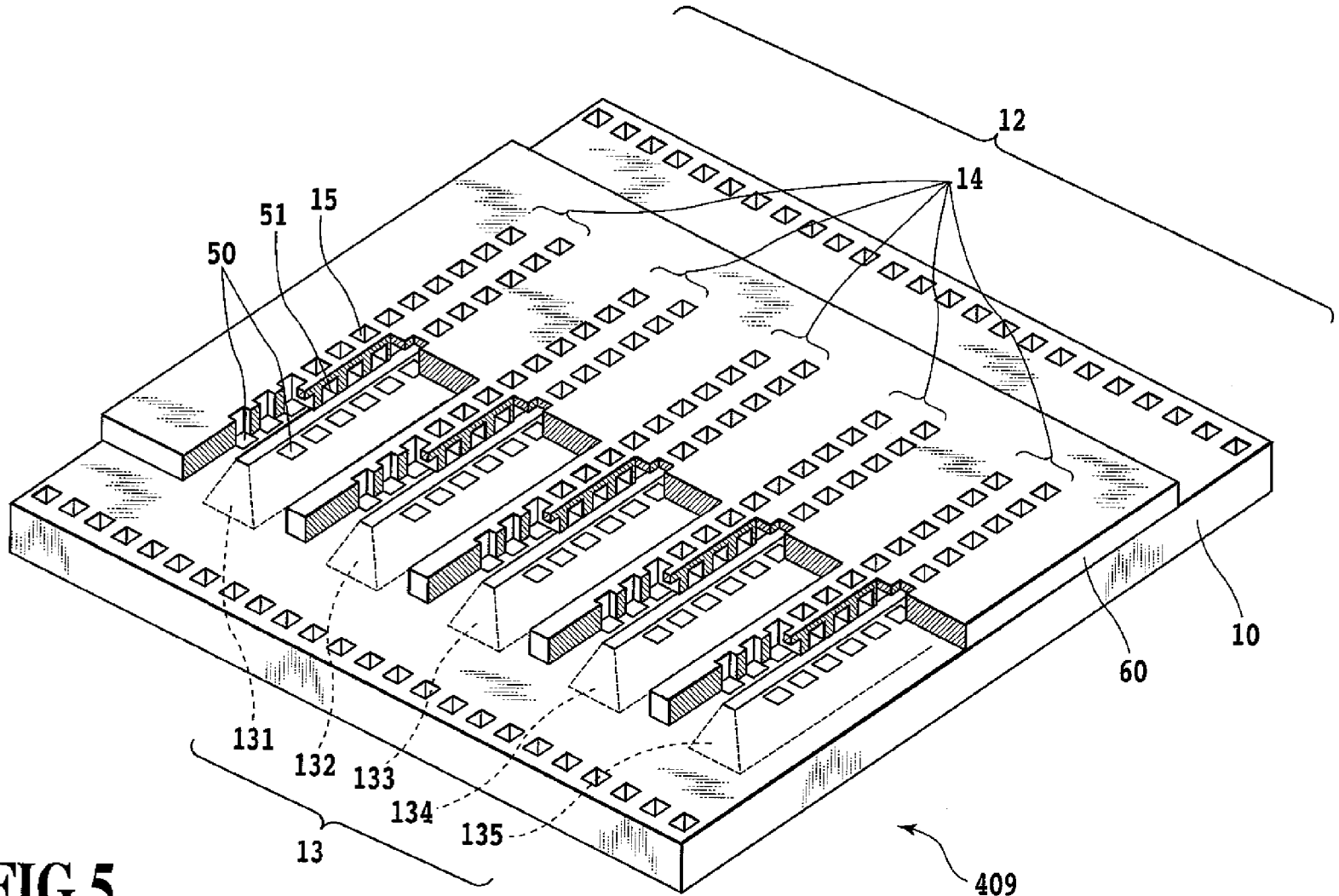
FIG. 5 is a perspective view showing a basic configuration example of a recording element board used in the configuration of FIG. 4.

FIG. 5 is a perspective view showing a basic configuration example of the recording element board 409. The board 409 has, on one surface of a Si substrate 10, arrays of multiple heat generating portions 50 which generate a heat energy used for ejecting ink. On the substrate 10, an ejection opening forming member 60 is disposed. The ejection opening forming member 60 is made of a resin material, and ink ejection openings 15 and ink paths 51 are formed by a known photolithography technique. Thereby, the ink ejection openings 15 face to the heat generating portions 50. The ejection openings 15 communicate with corresponding ink supplying ports 131 to 135 (unless specified, referred to as a reference numeral 13) via the ink paths 51. The ink supplying ports 13 have long-groove forms extending to the corresponding arrays of the ejection openings 15 or the heat generating portions 50, and penetrates through the substrate 10 and have openings on the back side. The openings on the back side correspond to the ink communication holes 407 formed in the first plate 406, and receive ink supplied therefrom. Note that, hereinafter, the ejection opening 15, the ink path 51 communicating therewith, and the heat generating portion 50 disposed thereon are referred to as a nozzle.

The ink supplying ports 13 can be formed by a method such as anisotropic etching or sand blast utilizing Si crystal orientation. For example, in a case of the Si substrate 10 having the crystal orientation of <100> in a wafer direction and <110> in a thickness direction, the etching can be progressed to the Si substrate 10 at an angle of approximately 54.7 by means of the anisotropic etching using an alkaline etching solution. In this manner, the etching is performed to a desired depth, and the ink supplying ports 13 serving as through holes in long-groove forms can be formed. Note that, as the alkaline etching solution, for example, KOH, TMA and hydrazine can be used.

The electric wirings for supplying electric power to the heat generating portions 50 are formed by a known film forming technique using, for example, Al. Moreover, electrodes 12 for supplying electric power to the electric wirings are arranged along the opposing edge portions of the recording element board 409, i.e. the edge portions perpendicular to the arrangement direction of the heat generating portions 50. To the electrode 12, a bump of, for example, Al is formed, and is jointed to a lead terminal of the electric wiring tape 412 by a thermal ultrasonic compression bonding technique.

Note that, although the first recording element board 410 is formed in the same manner as the recording element board 409 for color ink, only one color (black) of ink is supplied thereto, so that the first recording element board 410 has a single ink supplying port, on both sides of which nozzle arrays are formed.

Specifics of Ejection Opening Arrays of Recording Head

Next, specifically described will be the configuration of the second recording element board 409, especially the ejection opening arrays thereof, for color ink according to the present embodiment.

Figure 6A:
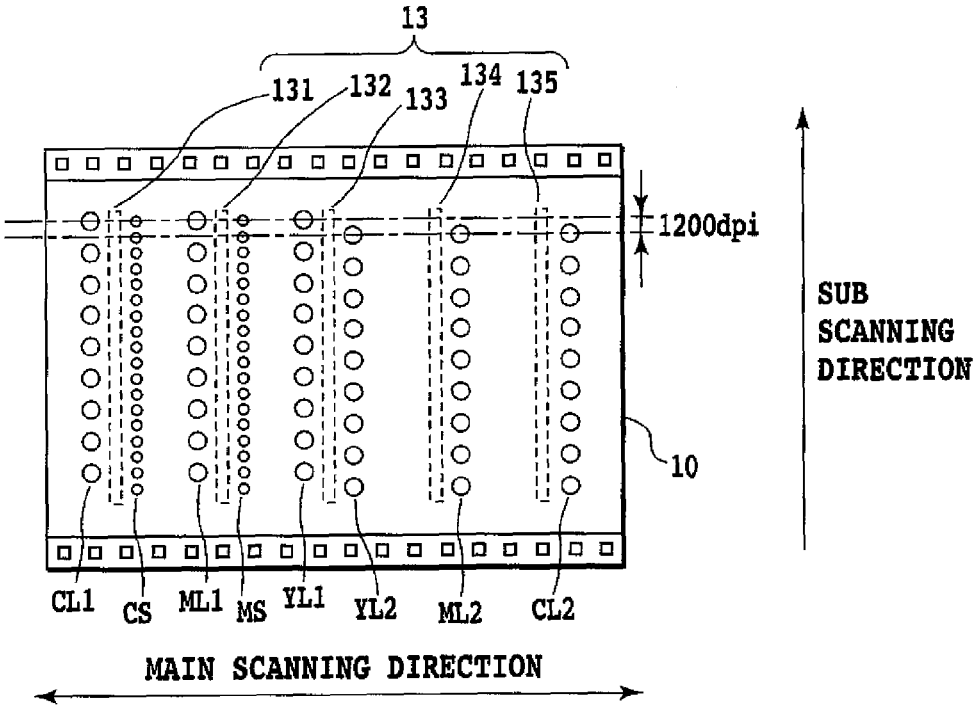
FIG. 6A shows a configuration of ejection opening arrangements of a recording head according to a first embodiment of the present invention, and is a drawing showing a state where the recording head is mounted without inclining to a main scanning direction.
Figure 16A:
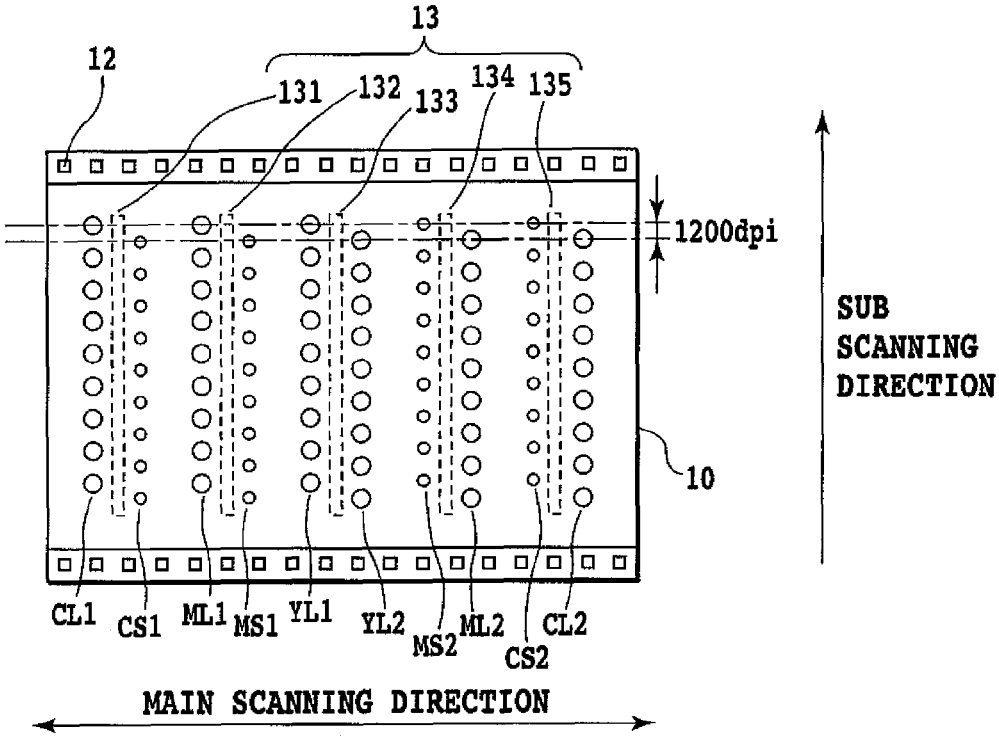
FIG. 16A shows a configuration of ejection opening arrangements of a conventional recording head, and is a drawing showing a state where the recording head is mounted without inclining to a main scanning direction.

FIG. 6A is a schematic front view of the recording element board 409 showing the configuration example of the ejection opening arrays thereof. Here, the same components as those of the FIG. 16A are denoted by the same reference symbols. In this example, eight ejection opening arrays are provided. Among these, the ejection opening arrays (CL1, ML1, YL1, YL2, ML2 and CL2) which eject relatively large amounts of ink have the same configurations as those in FIG. 16A, and are symmetrically disposed about the yellow supplying port 133. This example is different from the conventional configuration in the following points. Specifically, the symmetrical disposition is not made for the ejection opening arrays for the cyan ink and the magenta ink both of which eject relatively small amounts of ink. The ejection opening array which eject relatively small amounts of ink is provided to only one side of each of the ink supplying ports for cyan and magenta inks. Then, ejection opening arrays CS and MS are formed. Each of the ejection opening arrays CS and MS is a single array, and obtain the same recording density as that of the conventional configuration.

In other words, in the ejection opening arrays which eject relatively large amounts of ink, the ejection openings are arranged in the sub scanning direction with a density of 600 dpi, i.e. at a pitch of approximately 42 μm (1/600 inch). In the relation between the ejection opening arrays, the ejection openings are offset by ½ of the arrangement pitch (approximately 20 μm). Accordingly, the two ejection opening arrays which eject relatively large amounts of ink complement each other, achieving a recording resolution of 1200 dpi. On the other hand, as to the ejection opening arrays CS and MS which eject relatively small amounts of the cyan ink and the magenta ink, the ejection opening arrays are disposed only to the ink supplying ports 131 and 132. The ejection openings are arranged in the sub scanning direction with a density of 1200 dpi, i.e. at a pitch of approximately 21 μm. Accordingly, each of the ejection opening arrays CS and MS achieves a recording resolution of 1200 dpi with only the single array. In this respect, as long as the nozzle can eject ink at an amount of approximately 3 pl or less, it is possible to achieve a arrangement density of 1200 dpi.

Note that, in this embodiment, 128 ejection openings are arranged in the ejection opening arrays which eject relatively large amounts of ink. The preferred ejection amount is from 3 pl to 10 pl, which makes it possible to fill wide range of area of the recording medium efficiently with a small number of ink droplets, and which makes it possible to form an image at a high speed. In this embodiment, the ejection openings are capable of ejecting an ink of 5.5 pl. On the other hand, 256 ejection openings are arranged in the ejection opening arrays which eject relatively small amounts of ink. The preferred ejection amount to perform highly precise recording without granular impression is from 0.5 pl to 2 pl. In this embodiment, the nozzle is capable of ejecting an ink of 1.3 pl. Since the yellow ink has relatively low visibility as compared to the cyan ink and the magenta ink, the granular impression thereof is not substantially influenced even by larger dots. The effect of reducing the droplet size is small. Thus, only the ejection opening arrays YL1 and YL2 which eject large amounts of ink are provided.

By mounting the recording head having such ejection opening arrays on the apparatus shown in FIG. 1, when recording is performed especially emphasizing the speed relative to a plain paper sheet, the bidirectional recording can be performed on the same image area as by using only the nozzle arrays which eject large amount of ink. At this time, since the nozzle arrays of the same color are symmetrically disposed, the order of applying ink can be made as same as that in the forward and backward scanning directions, and thereby it is possible to prevent the unevenness in the secondary color from occurring.

Moreover, when images such as pictures are formed, by performing the multiple main scanning (multi-pass recording) in accordance with the pixel arrangement complementary to the same image area, for example, while effectively utilizing the ejection opening arrays which eject small amounts of ink, it is possible to form a highly precise image with less granular impression. In this embodiment, although the ejection opening arrays for cyan and magenta which eject small amounts of ink are not symmetrically disposed, it is possible to suppress the variation in color by performing the multi-pass recording.

Figure 16B:
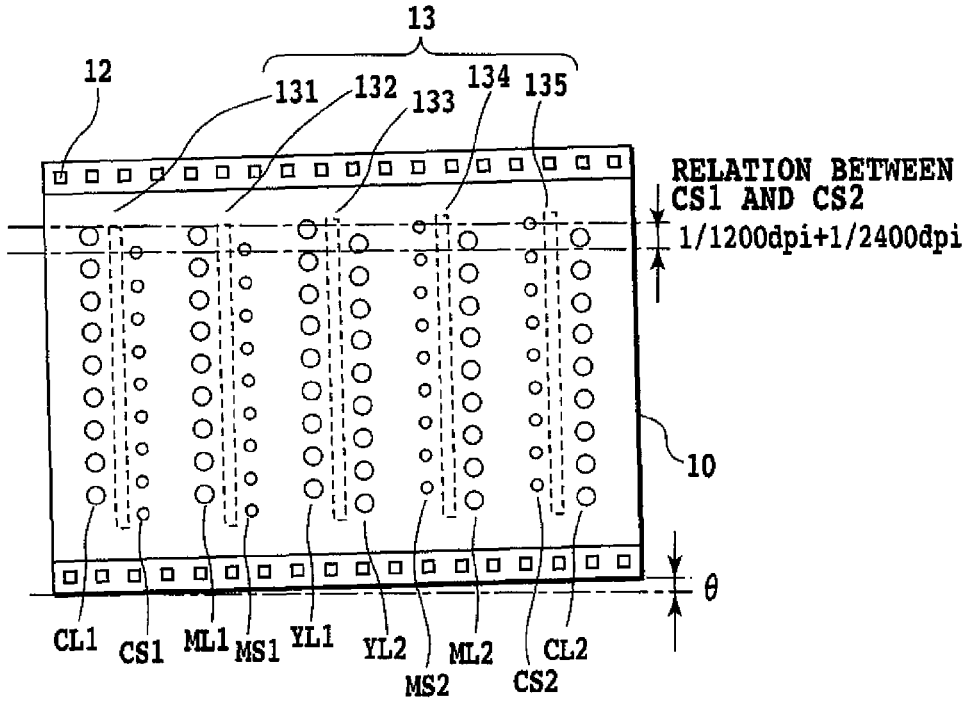
FIG. 16B is a drawing showing a state where the recording head is mounted with inclining to the main scanning direction.
Figure 17A:
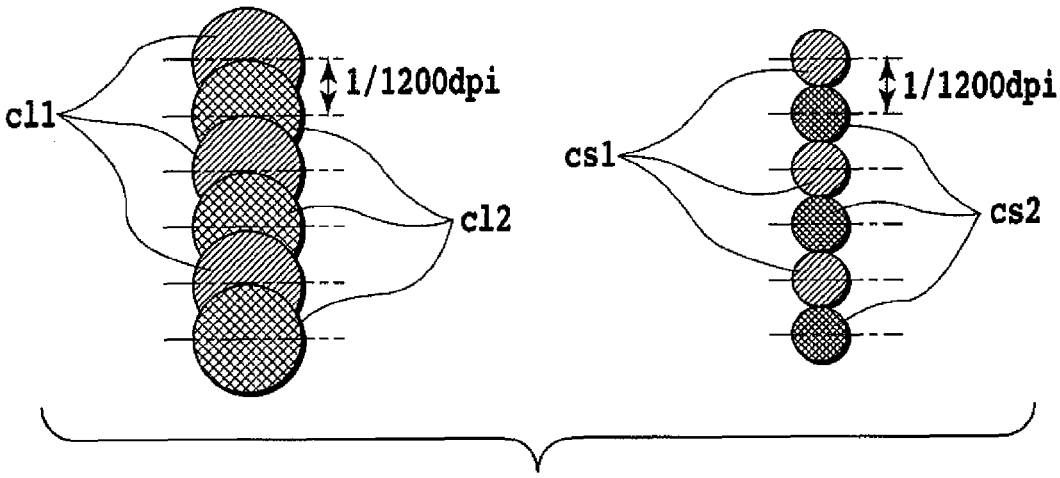
FIGS. 17A and 17B are drawings showing dots formed in the states of FIGS. 16A and 16B, respectively.
Figure 17B:
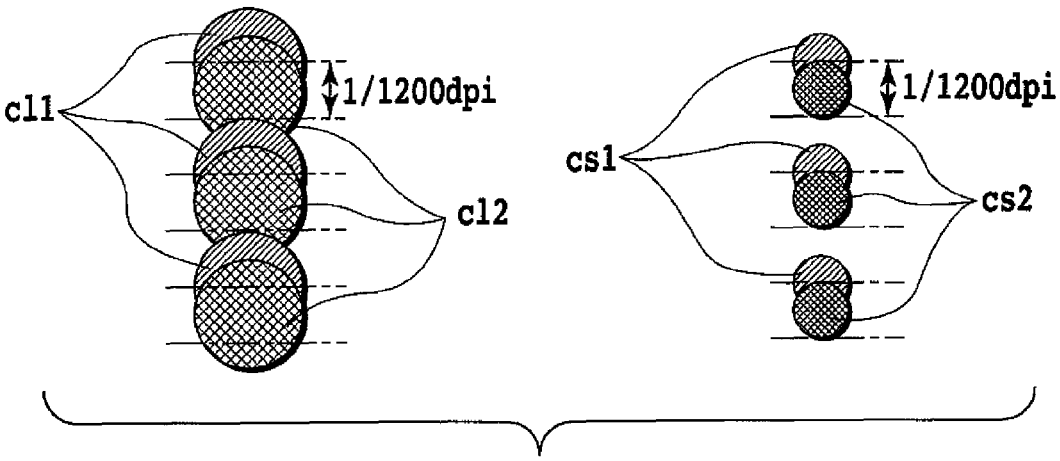

The problem of the variation in manufacturing described using FIGS. 16B and 17B can be avoided as follows.

Figure 6B:
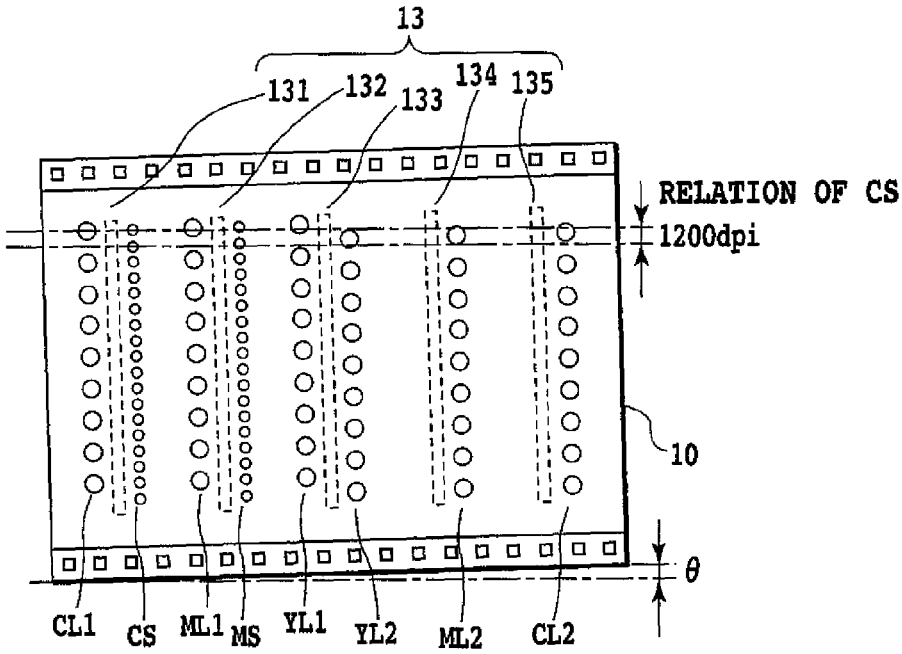
FIG. 6B is a drawing showing a state where the recording head is mounted with inclining to the main scanning direction.
Figure 7A:
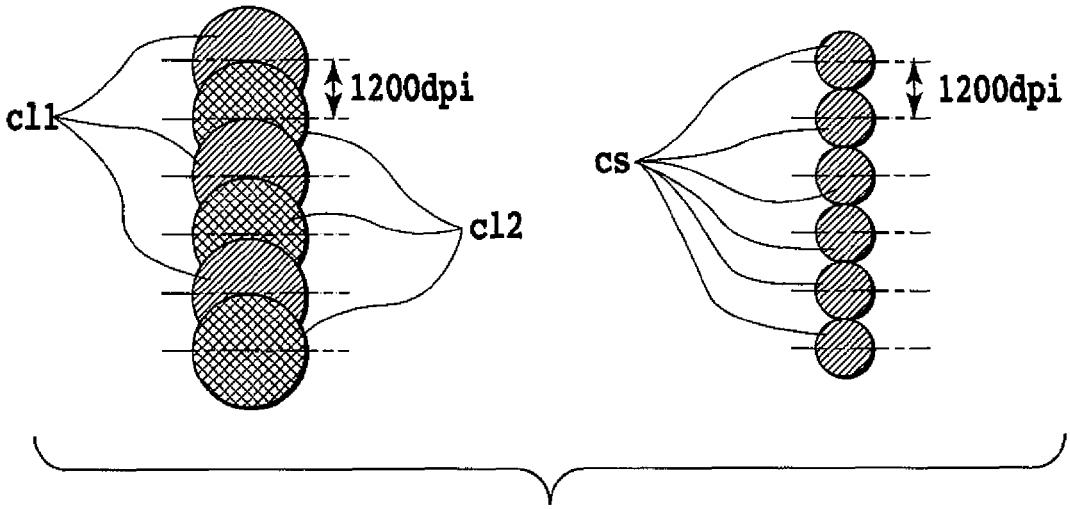
FIGS. 7A and 7B are drawings showing dots formed in the states of FIGS. 6A and 6B, respectively.
Figure 7B:
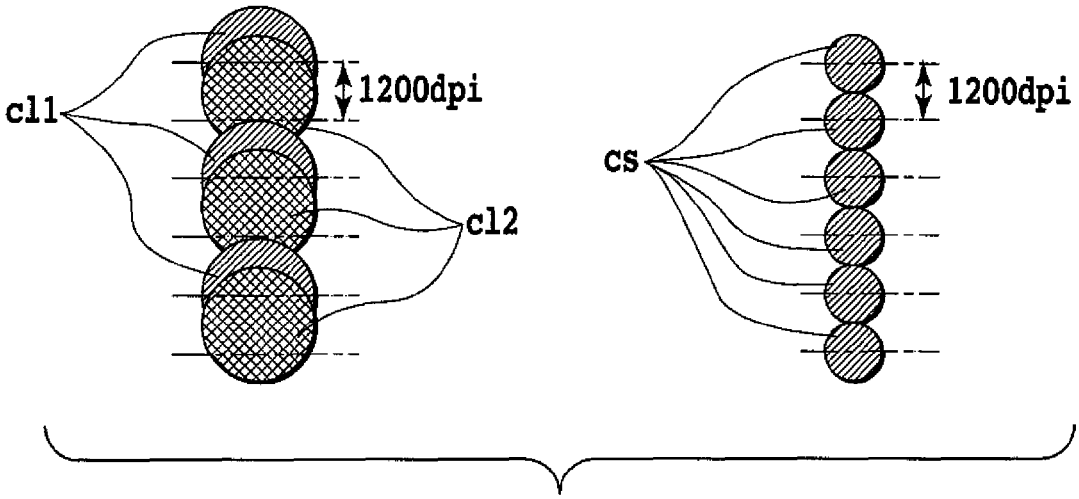

FIG. 6B is a drawing showing a state where the recording head shown in FIG. 6A is inclined to the direction in which the guide shaft extends, i.e. the main scanning direction by an angle θ. FIGS. 7A and 7B are schematic views showing the states where the dots are formed by the ejection opening arrays for the cyan ink without inclining of the recording head (FIG. 6A) and with the inclined recording head (FIG. 6B), respectively. In FIGS. 7A and 7B, each of the drawings on the left shows the arrangement of the dots c11 and c12 having relatively large diameters which are formed by the ejection opening arrays CL1 and CL2 which eject relatively large amounts of ink, respectively. On the other hand, the drawings on the right shows the arrangements of the dots cs with relatively small diameters, which are formed by the ejection opening arrays CS which eject relatively small amounts of ink, respectively.

In FIG. 6A, since each ejection opening array is accurately vertical to the guide shaft 103, the ejection opening arrays CL1 and CL2 are positioned regularly on the main scanning direction. In other words, in this example, the ejection openings of the ejection opening arrays CL1 and CL2 complement each other. Thus, the dots which are not shifted can be formed as shown in the drawing on the left of FIG. 7A. Moreover, even in a state where each ejection opening array is inclined to the guide shaft 103 as shown in FIG. 6B, if the ejection amount is sufficiently large, the formed dot diameter is also sufficiently large relative to the shifted distance as shown in the drawing on the left of FIG. 7B, and the influence of change in the area factor can be ignored.

On the other hand, the ejection openings which eject relatively small amounts of ink is arranged in a single array in the sub scanning direction in this example, eliminating the problem of the shifting of the dot forming position due to the distance in the main scanning direction as in the conventional example. In other words, even if the ejection opening arrays are perpendicular to the guide shaft 103, or inclined, it is possible to form the dots which are not shifted as shown in the drawings on the right of FIGS. 7A and 7B. Accordingly, the area factor does not change in the sub scanning direction.

For this reason, there is no problem that the optical density of entire image would be reduced, and that the stripes in the horizontal direction are more likely to be noticeable. Moreover, the ejection openings which eject relatively small amounts of ink is arranged in a single array, and this arrangement eliminates the problems that the color balance may deteriorate as a whole, and that the shifting distance of dots may vary in some kind of color due to the difference between the positions of the ejection openings in the main scanning direction. Furthermore, as to the dynamic factors such as vibration of the carriage or the guide shaft at the time of the main scanning, the problem of the variation in the optical density which occurs because of the difference between the positions of the ejection opening arrays on the main scanning direction, and thus the problem of the stripes in the sub scanning direction (vertical direction) does not occur.

As described above, in the recording head having the ejection opening arrangement according to this embodiment, the ejection opening arrays which eject relatively large amounts of ink are disposed symmetrically. Thereby, it is possible to perform the bidirectional recording without color unevenness, and the recording at a higher speed is achieved. Moreover, each of the ejection opening arrays which eject relatively small amounts of ink are disposed into a single array. Thereby, it is possible to avoid the reduction in optical density, the stripes and the unevenness in image which are caused by the static and dynamic factors at the time of highly precise recording such as multi-pass recording.

Note that the effect of the present invention is not limited by the arrangement density of the ejection openings. Suppose a case where the number of ejection openings which eject relatively small amounts of ink is set to 128, and these ejection openings are arranged into a single array in the sub scanning direction at a pitch of approximately 42 μm (1/600 inch). In this case, by controlling the paper feeding (the sub scanning amount), it is possible to form an image equivalent in quality. Nevertheless, the less ejection openings and arrangement density causes the number of passing (the number of the main scanning in the same image area) to be increased when the multi-pass recording is performed. As a result, the recording speed is slowed. Accordingly, this embodiment is advantageous since the arrangement density of the ejection openings which eject small amounts of ink is twice as large as that of ejection openings which eject large amounts of ink, making the total number of ejection openings equal, and thereby the recording speed is not slowed.

Second Embodiment

Figure 8:
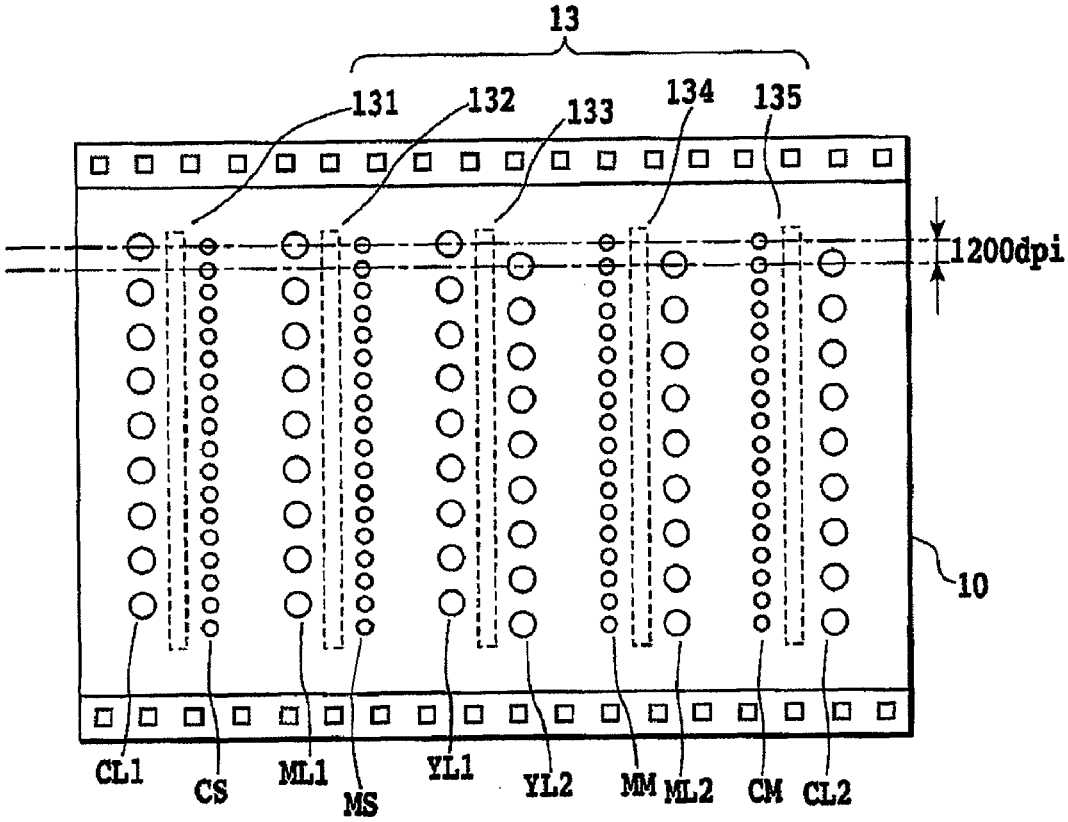
FIG. 8 is a drawing showing a configuration of ejection opening arrangements of a recording head according to a second embodiment of the present invention.

FIG. 8 shows a second embodiment of a configuration of ejection opening arrangement which can be applied to the second recording element board. Here, the same components as those of the first embodiment shown in FIG. 6A are denoted by the same reference symbols.

This embodiment is different from the first embodiment in the following point. The configuration of the first embodiment is further provided with arrays of ejection openings or nozzles which eject middle amounts of cyan and magenta inks, the middle amount being an intermediate amount between large and small ejection amounts. Thus, the total of ten ejection opening arrays are disposed to the resulting configuration. In the first embodiment, only the ejection opening array which eject relatively large amounts of ink has been provided to one side of the respective ink supplying ports 135 and 134. In addition, the ejection openings (ejection opening arrays CM and MM) which eject intermediate amounts of ink are arranged to the other sides of the ink supplying ports 135 and 134 with a density of 1200 dpi in the present embodiment. The gradation of middle tone can be improved, for example, by using these ejection openings in an intermediate optical density area between a low optical density area where the ejection openings which eject relatively small amounts of ink are mainly used and a high optical density area where the ejection openings which eject relatively large amounts of ink are mainly used. The preferred ejection amount is from 2 pl to 3 pl. In this example, the ejection amount of the ejection openings in the ejection opening arrays CM and MM was 2.7 pl which is approximately the middle amount between the ejection amount (5.5 pl) which is relatively large in the first embodiment and the ejection amount (1.3 pl) which is relatively small.

Note that, since yellow ink has relatively low visibility as compared to the cyan ink and the magenta ink, the granular impression thereof is not substantially influenced even by the larger dots. The effect of reducing the droplet size is small. Thus, only the ejection opening arrays YL1 and YL2 which eject large amounts of ink are provided.

When recording is performed, especially emphasizing the speed relative to a plain paper sheet, by mounting a recording head having such ejection opening arrays on the apparatus shown in FIG. 1, the bidirectional recording can be performed on the same image area by using only the nozzle arrays which eject large amount of ink. At this time, since the nozzle arrays for the same color are symmetrically disposed, the order of applying ink can be made as same as that in the forward and backward scanning directions, and thereby it is possible to prevent the unevenness in the secondary color from occurring.

Furthermore, by performing multi-pass recording, while effectively utilizing the ejection opening arrays which eject small amounts of ink and the ejection opening arrays which eject intermediate amounts of ink, it is possible to form a highly precise image with less granular impression from the low optical density area to the intermediate optical density area. In other words, it is also possible to avoid the problems caused by the static and dynamic factors described by using FIGS. 16B and 17B.

Third Embodiment

In the aforementioned embodiment, while two arrays of the ejection openings which eject relatively large amounts of ink are disposed symmetrically, a single array of the ejection openings which eject relatively small amounts is disposed. As apparent from FIG. 6A, the ejection openings are arranged in a straight line in the sub scanning direction. However, the present invention does not indicate that it is always necessary to arrange the ejection openings in a straight line. As long as the given object to avoid the problems caused by the static and dynamic factors is achieved, the present invention also includes a case where ejection openings are arranged in a range having a certain width in the main scanning direction. In other words, "a single array" herein refers to not only a case where the ejection openings are arranged in a straight line in the sub scanning direction, but also a case where the ejection openings are arranged in a certain range in the main scanning direction as long as the achievement of the given object is not inhibited, that is, a case where the ejection openings are arranged substantially in a straight line in the main scanning direction.

Before the description of an embodiment in which ejection openings are arranged substantially in a straight line below, a result of an examination which the present inventors has made will be described.

Firstly, the present inventors have examined the range of ejection opening arrangement which can be considered as the substantially single array in various forms of ejection opening arrangement which can be applied to a recording element board.

Figure 9:
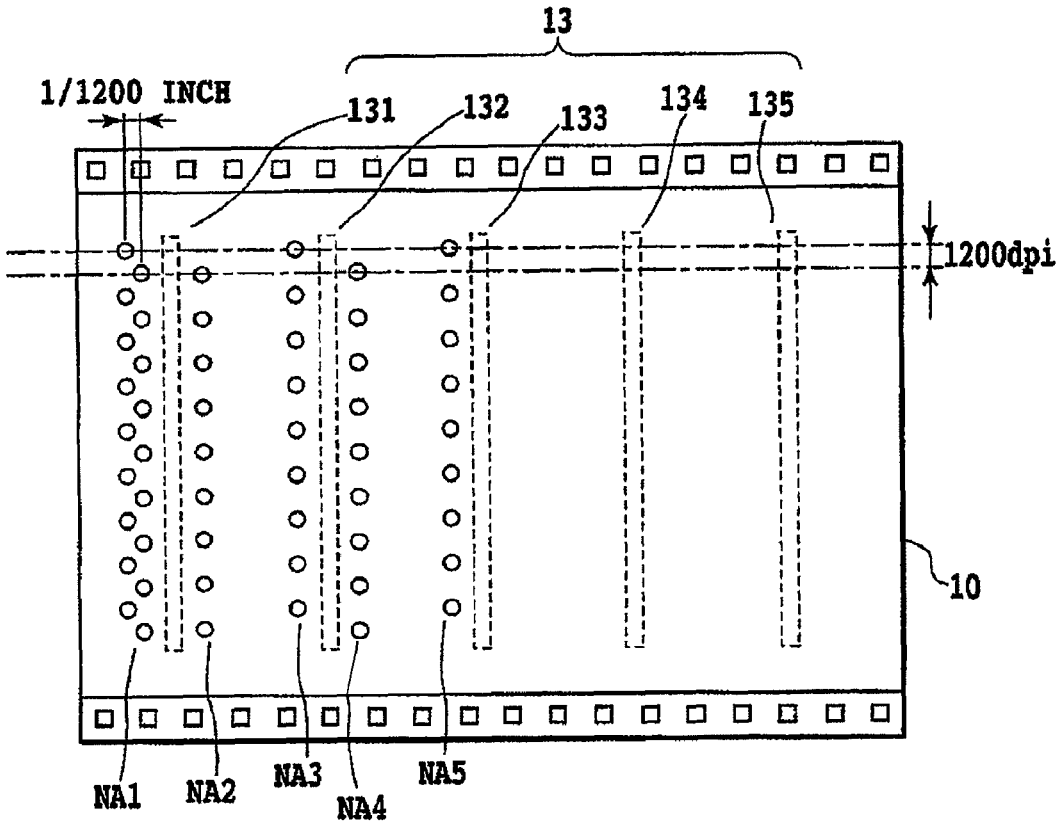
FIG. 9 is a drawing showing a configuration of ejection opening arrangements of recording head used for examination in adopting configurations of third to sixth embodiment of the present invention.

FIG. 9 is a schematic plan view showing a configuration of ejection opening arrays on the recording element board used for the examination. In this example, in the configuration same as that of the recording element board 409, nozzle arrays are formed on both sides of the three ink supplying ports (131 to 133) among the five ink supplying ports 13 (131 to 135) while interposing each of the ink supplying ports in between, or the nozzle arrays are formed on one side thereof. Ejection openings which constitute the nozzles are equivalent to the ejection openings which eject relatively small amounts of ink in the first and second embodiments, and can eject ink at an amount of 1.3 pl in a single ejection operation. The arranged ejection opening arrays are denoted by reference symbols NA1, NA2, NA3, NA4 and NA5 in an order from the leftmost portion of an illustrated board.

Here, in the ejection opening arrays NA1 which are disposed on the left side of the ink supplying port 131, and which are positioned at the leftmost portion of the board, the ejection openings are arranged in a staggered pattern. More precisely, two arrays of the ejection openings with an arrangement density of 600 dpi in the sub scanning direction are disposed adjacent to each other in the main scanning direction. The arrangement pitch of these arrays in the main scanning directions is 40 μm. Moreover, in the relation between the ejection opening arrays, the ejection openings are offset by ½ of the arrangement pitch in the sub scanning direction, achieving a recording resolution of 1200 dpi.

Figure 10:
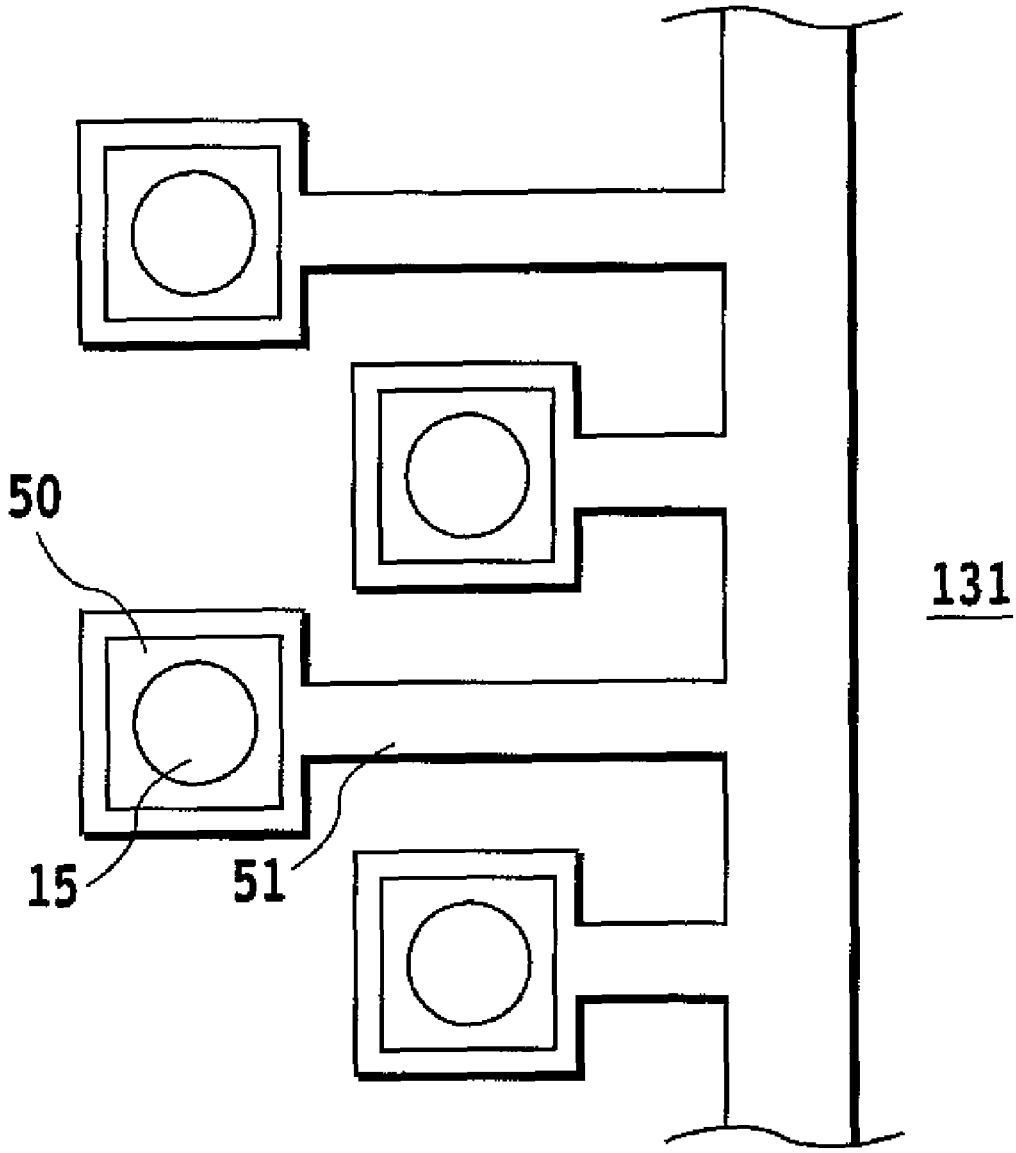
FIG. 10 is a drawing showing an enlarged part of FIG. 9.

FIG. 10 is a schematic view showing an enlarged part of FIG. 9. As shown in this drawing, two kinds of ink paths 51 having different distances from the ink supplying port are alternatively arranged on one side of the ink supplying port 131. Thereby, the staggered manner arrangement of nozzles or ejection openings 50 are made possible. In other words, it is possible to design these forms relatively freely without aligning the nozzles or ejection openings 50 adjacent to each other in the sub scanning direction.

In the ejection opening arrays NA2, NA3, NA4 and NA5, the ejection openings are arranged in a straight line with a density of 600 dpi in the sub scanning direction. Here, the ejection openings in the ejection opening arrays NA2 and NA4 are lined up with the ejection openings on the right side of the ejection opening arrays NA1, while the ejection opening arrays NA3 and NA5 are lined up with the ejection openings on the left side of the ejection opening arrays NA1. Specifically, the ejection openings in the ejection opening arrays NA2 and NA4 are offset from the ejection openings in the ejection opening arrays NA3 and NA5 by ½ of the arrangement pitch in the sub scanning direction. The distance between the ejection opening array NA3 and NA4 in the main scanning direction is 200 μm. The distance between the ejection opening array NA2 and NA3 in the main scanning direction is 1000 μm. The distance between the ejection opening array NA2 and NA5 in the main scanning direction is 2200 μm.

Next, the ejection opening arrays NA1 to NA5 are combined as described below. Then, assuming a case where the maximum variation occurs in manufacturing, an examination is made on relationships between image deterioration (reduction in optical density, stripes, image unevenness), and the distance between the ejection opening arrays in the main scanning direction. The maximum variation in manufacturing is based on the assumption that a complementary relationship between the ejection opening arrays is not established when ejection opening arrays are inclined as shown in FIG. 16B. In other words, the arrangement pitches are shifted in the sub scanning direction from appropriate positions of the ejection opening arrays (CS1 and CS2) which have the largest distance therebetween, and which are supposed to complement each other, and thereby the ejection openings of the two arrays line up in the main scanning direction (dots formed by the two arrays completely overlap).

- Case 1: recording with only the ejection opening arrays NA1 (the distance between the arrays in the main scanning direction: 40 μm)
- Case 2: recording with the ejection opening arrays NA3 and NA4 (the distance between the arrays in the main scanning direction: 200 μm)
- Case 3: recording with the ejection opening arrays NA2 and NA3 (the distance between the arrays in the main scanning direction: 1000 μm)
- Case 4: recording with the ejection opening arrays NA2 and NA5 (the distance between the arrays in the main scanning direction: 2200 μm)

The recording was performed by forming an image with use of a paper sheet for photograph (PR101 manufactured by Canon Inc. in this examination) which had a general ink receiving layer and with use of two color inks which were cyan and magenta. By recording gradation (gradation was graded from highlight to solid color), image evaluation was made in accordance with the degree of deterioration of image in a gradation range using the above 1.3 pl nozzle.

As a result, in Case 1 and Case 2, no image deterioration was observed. In Case 3, slight image deterioration was observed. In Case 4, the image deterioration was significance. Meanwhile, the difference in each ink color was not substantially observed.

From the evaluation results, it was found that there were no problems in images in the staggered manner arrangement of the ejection openings such as the ejection opening arrays NA1 and the disposition of the ejection opening arrays (the relation between the ejection opening arrays NA3 and NA4) while interposing the ink supplying port therebetween. Thus, these can be considered as the substantially single array. In other words, it was found that as long as two ejection opening arrays were disposed within a width of 200 μm or less in the main scanning direction, these can be considered as the substantially single array.

Figure 11:
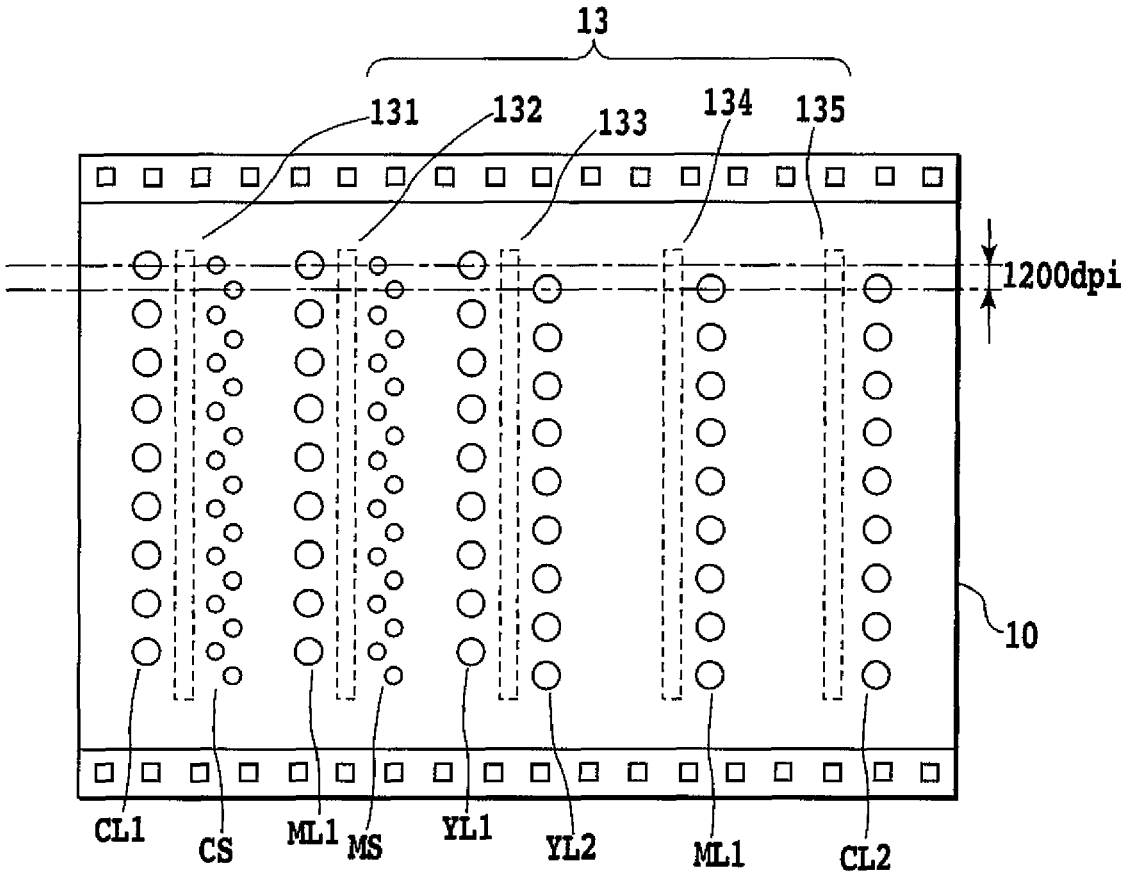
FIG. 11 is a drawing showing a configuration of ejection opening arrangements of a recording head according to a third embodiment of the present invention.

FIG. 11 is a schematic plan view showing a configuration of ejection opening arrays of the recording element board 409 according to a third embodiment of the present invention based on the above evaluation results.

In this embodiment, the ejection openings of the ejection opening arrays CS and MS which eject relatively small amounts of ink are arranged in the staggered manner such as the ejection opening arrays NA1, in the configuration similar to that of the first embodiment. The offset distance of each ejection opening array in the main scanning direction is 40 μm. As apparent from the examination results, in this arrangement, each of the ejection openings for cyan and magenta can be considered as being arranged as the single array.

Images are actually formed using the recording head which has the recording element board of this configuration. From the review of this result, there were no problems that the optical density of image was reduced as a whole, and that the stripes in the horizontal direction were more likely to be noticeable, in any image. Moreover, it was possible to avoid the problem caused by the dynamic factors as in the case of the first embodiment.

Fourth Embodiment

Figure 12:
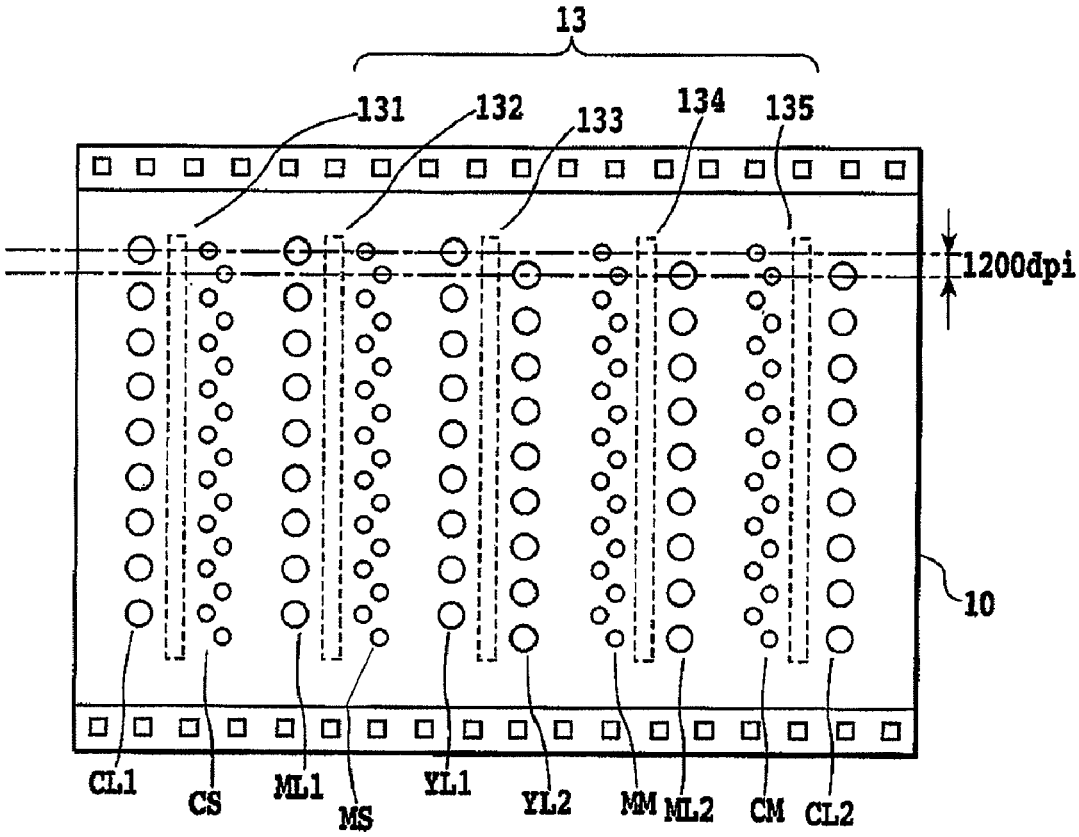
FIG. 12 is a drawing showing a configuration of ejection opening arrangements of a recording head according to a fourth embodiment of the present invention.

FIG. 12 is a schematic plan view showing a configuration of ejection opening arrays of the recording element board 409 according to a fourth embodiment of the present invention. In this embodiment, the ejection opening arrays which eject intermediate amounts of ink as described in the second embodiment are applied to the configuration of the third embodiment, and furthermore in the ejection opening arrays, the ejection openings are arranged in the staggered manner such as the ejection opening arrays NA1.

The ejection opening arrays which eject intermediate amounts of ink ejection, and which have the staggered manner arrangement can also be considered that the ejection openings are arranged in the single array as described above. By using the recording head which has the recording element board with the above configuration, images are actually formed. From the review of this result, the same effect as that of the second embodiment was obtained in any image.

Fifth Embodiment

Figure 13:
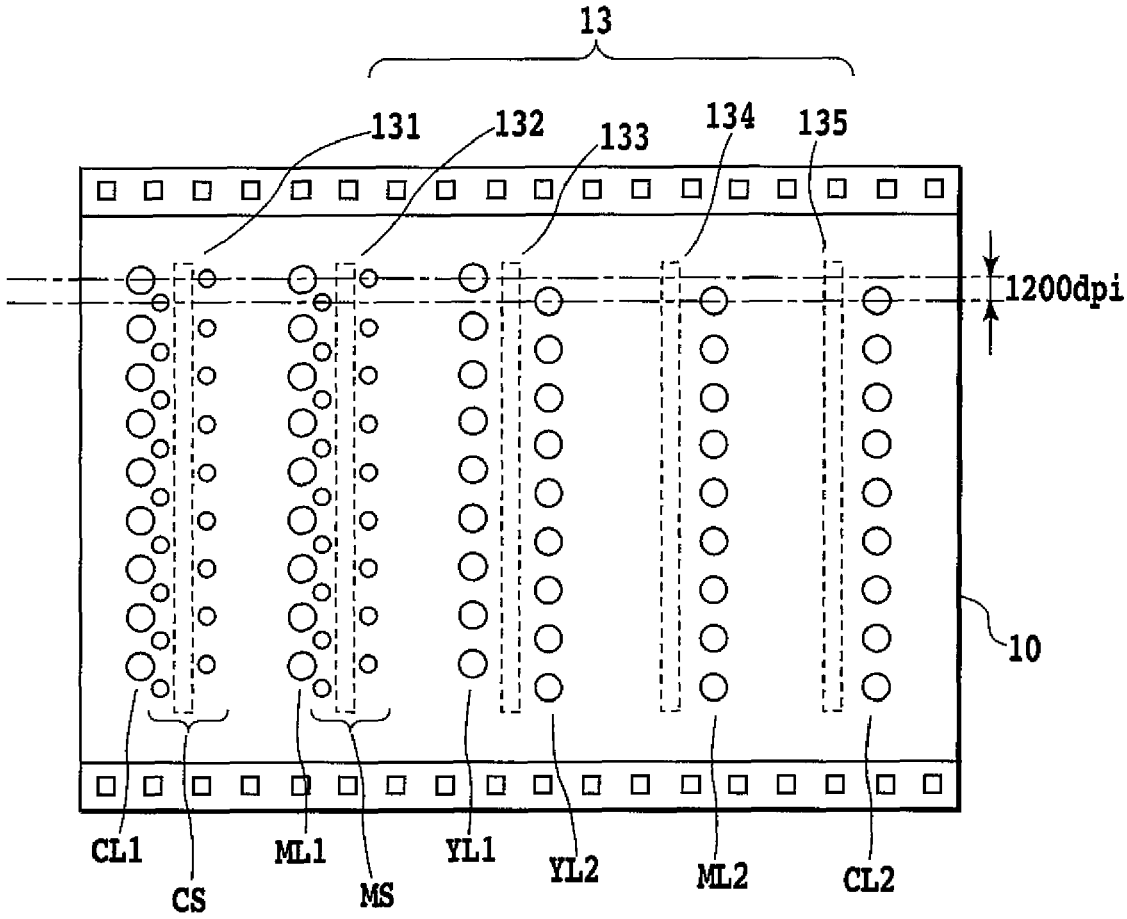
FIG. 13 is a drawing showing a configuration of ejection opening arrangements of a recording head according to a fifth embodiment of the present invention.

FIG. 13 is a schematic plan view showing a configuration of ejection opening arrangement of the recording element board 409 according to a fifth embodiment of the present invention. In this embodiment, the ejection opening arrangement (CL1, ML1, YL1, YL2, ML2 and CL2) which eject relatively large amounts of ink are arranged in the same manner as the first embodiment. On the other hand, each of the ejection opening arrays CS and MS which eject relatively small amounts of ink includes: an array in which ejection openings thereof are arranged so as to fill the space among the ejection openings which eject relatively large amounts of ink on one side of the ink supplying port; and an array in which ejection openings thereof are arranged on the other side of the ink supplying port. The arrangement density of both of these arrays is 600 dpi. In the relation between these arrays, by offsetting the arrangement pitch of the ejection openings by ½ in the sub scanning direction, a recording density of 1200 dpi is obtained.

It is difficult to arrange the ejection openings which eject relatively large amounts of ink with a density of 1200 dpi on the one side of the ink supplying port 131 from a viewpoint of the size of nozzle, especially the heat generating portion 50 which is a configuration element thereof. However, it is possible, if the ejection openings which eject relatively large amounts of ink are arranged with the ejection openings which eject relatively small amounts of ink in the staggered manner.

In this case, although the ejection opening arrays CS and MS which eject relatively small amounts of ink include the ejection openings arranged on both sides of the ink supplying ports 131 and 132, respectively, with the ink supplying ports in between, in response to the evaluation results described in association with the third embodiment, each of the ejection opening arrays CS and MS can be considered as the single array. By using the recording head which has the recording element board with the above configuration, images are actually formed. From the review of this result, the same effect as that of the first embodiment was obtained in any image.

Sixth Embodiment

Figure 14:
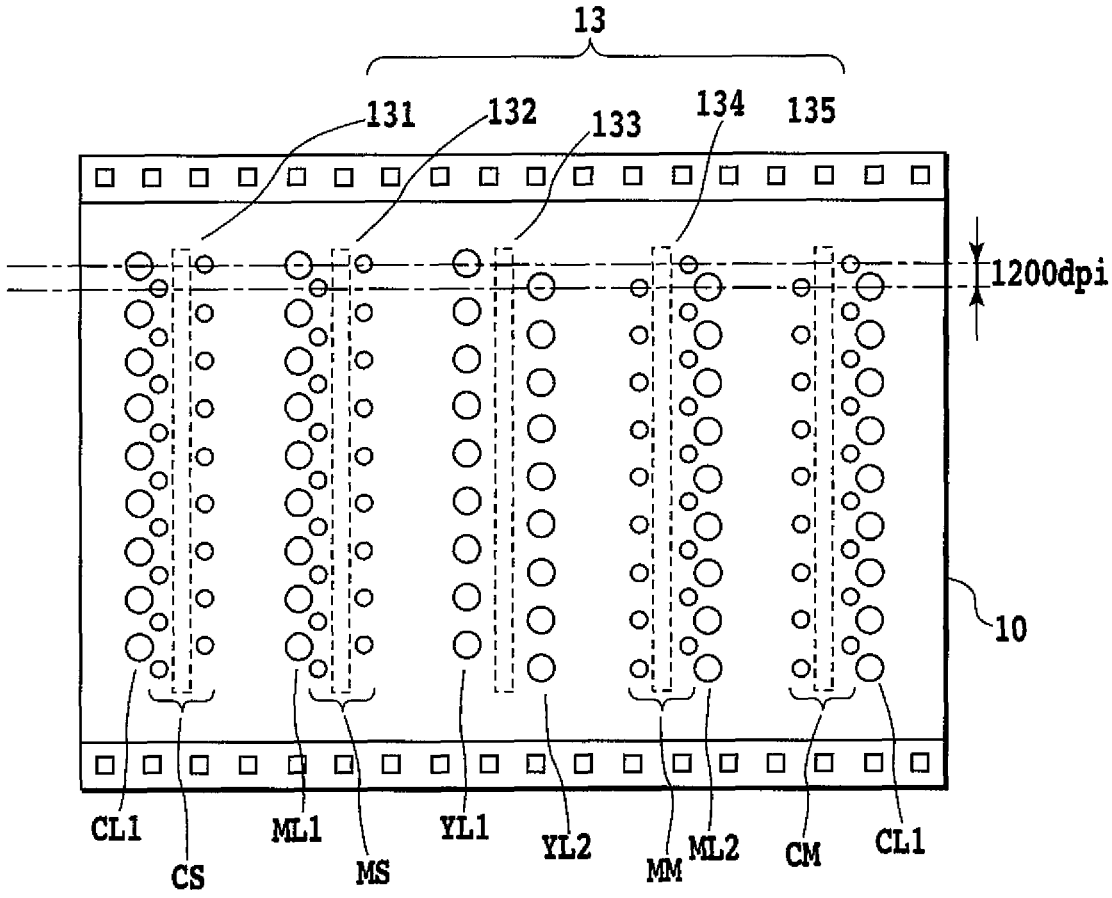
FIG. 14 is a drawing showing a configuration of ejection opening arrangements of a recording head according to a sixth embodiment of the present invention.

FIG. 14 is a schematic plan view showing a configuration of ejection opening arrangement of the recording element board 409 according to a sixth embodiment of the present invention. In this embodiment, the ejection opening arrays CM and MM which eject ink at intermediate amounts are applied to the configuration of the fifth embodiment. In the ejection opening arrays, the ejection openings are arranged in the staggered manner with the ink supplying ports 135 and 134 in between. Each of the ejection opening arrays CM and MM can be considered as the substantially single array.

Then, by using the recording head which has the recording element board with the above configuration, images are actually formed. From the review of this result, the same effect as that of the second embodiment was obtained in any image.

Others

Note that, in the above embodiments, description is given of the case where the recording element board or the recording head having the ejection opening arrays which eject the cyan, magenta and yellow inks is applied to the present invention. However, the color tones (colors and concentrations) to be used are not limited to this. Moreover, as long as the color may be varied because of different applying orders at the time of bidirectional recording, the number of color types and arrangement manner are not limited to the above embodiments. The point is that it is only necessary for the ejection opening arrays which eject large amounts of ink have the symmetrical disposition. Thus, it is also possible to apply, to recording media, inks in the order of magenta, cyan and yellow, even at the time of scanning in any one of the forward and backward directions.

Moreover, as to the yellow ink, the ejection opening arrays which eject relatively small amounts of the ink can be used. Furthermore, it is also possible to dispose ejection opening arrays for the black ink on the same recording element board as those for other color inks, but not to dispose on different recording element board. In this case, it is possible to obtain the effect of the present invention by disposing the ejection opening array which eject relatively small amounts of the black ink as the single array.

Figure 15:
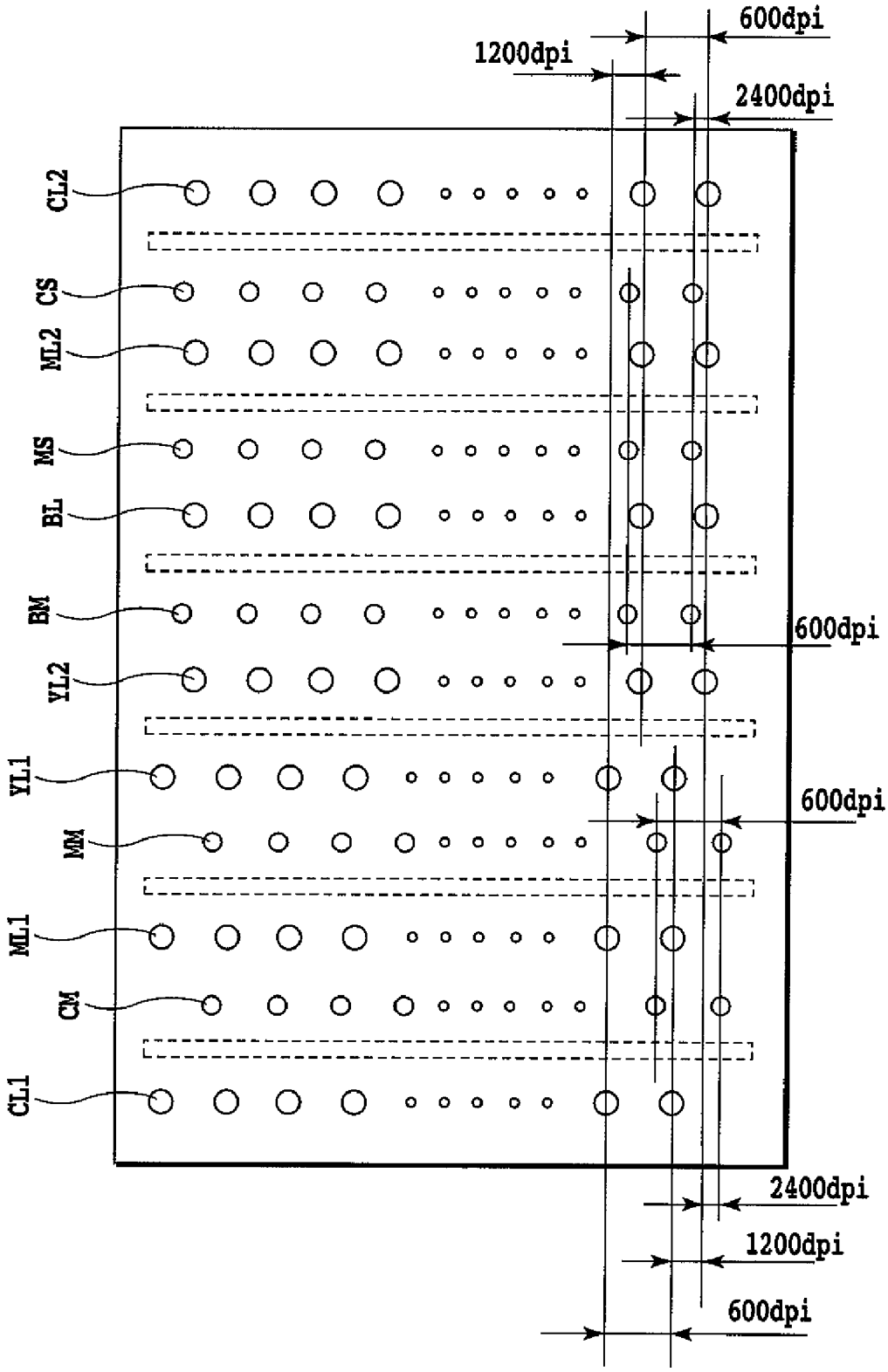
FIG. 15 is a drawing showing a configuration of ejection opening arrangements of a recording head according to a seventh embodiment of the present invention.

Furthermore, it is also possible to dispose ejection opening arrays on the recording element board 409 as a seventh embodiment shown in FIG. 15. In this example, an ejection opening array BL which ejects relatively large amounts of the black ink and an ejection opening array BM which eject relatively smaller amount of the black ink than the array BL are integrated into the recording element board. Note that the ejection opening array BM ejects the same amount of ink as the intermediate ejection amount adapted for the cyan and magenta inks. Moreover, the pitch of the ejection openings is as shown in FIG. 15.

In addition, in the above embodiments, description has been given of the configuration in which the electrothermal transducer element is used as an element for generating energy utilized to eject ink. The electrothermal transducer element generates heat energy for generating film boiling for ink in response to electric signals. However, image recording may be performed as follows. Specifically, an element which generates mechanical energy to increase or decrease the inner volume of the ink path communicating with the ejection opening is used as the energy generating element. Then, the driving force is generated, and the inner volume of the ink path is decreased or increased. Due to the change in the volume, pressure is applied to ink which is ejected to the recording medium.

Furthermore, in the above embodiments, the description has been made based on the assumption that each ejection opening array extends in the direction perpendicular to the main scanning direction. However, the present invention is effectively used even for a recording head based on a structure in which ejection opening arrays extend so as to be inclined relative to the main scanning direction. This is because such a recording head may also have a problem of image deterioration caused by variations in manufacturing. To be more precise, when the variations occur in manufacturing, ejection openings may be displaced from regular positions in the main scanning direction due to the distance between the two ejection opening arrays in the main scanning direction. Moreover, in the aforementioned embodiments, particularly in terms of the complementary relationship between two ejection opening arrays which eject relatively large amounts of ink, the ejection openings complement each other by being offset at the arrangement pitch by ½. It is needless to say that a relationship of the offset distance between ejection openings can be specified as appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-214180, filed Aug. 7, 2006, which is hereby incorporated by reference herein in its entirety.

What is claimed is:

1. An inkjet recording head comprising:

two first ink ejection opening arrays including a plurality of ink ejection openings which eject a first ink;

a second ink ejection opening array including a plurality of ink ejection openings which eject a second ink differing from the first ink;

a third ejection opening array including a plurality of ink ejection openings which eject larger amounts of the second ink than the second ink ejected from the second ink ejection opening array; and two fourth ejection opening arrays including a plurality of ink ejection openings which eject larger amounts of the second ink than the second ink ejected from the third ink ejection opening array, wherein one of the fourth ink ejection opening arrays, the second ink ejection opening array, one of the first ink ejection opening arrays, the other of the first ink ejection opening arrays, the third ink ejection opening array and the other of the fourth ink ejection opening arrays are arranged side by side in this order.

2. The inkjet recording head as claimed in claim 1, wherein the first ink is a yellow ink.

3. The inkjet recording head as claimed in claim 1, wherein the second ink is a magenta ink or a cyan ink.

* * * * *